US009937495B2

(12) United States Patent
Srinivas et al.

(10) Patent No.: US 9,937,495 B2
(45) Date of Patent: Apr. 10, 2018

(54) HYDROGEL MICROSTRUCTURES WITH IMMISCIBLE FLUID ISOLATION FOR SMALL REACTION VOLUMES

(71) Applicant: Massachusetts Institute of Technology, Cambridge, MA (US)

(72) Inventors: Rathi Lakshmi Srinivas, Cambridge, MA (US); Patrick S. Doyle, Sudbury, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 159 days.

(21) Appl. No.: 14/525,189

(22) Filed: Oct. 27, 2014

(65) Prior Publication Data

US 2015/0119280 A1 Apr. 30, 2015

Related U.S. Application Data

(60) Provisional application No. 61/896,637, filed on Oct. 28, 2013.

(51) Int. Cl.
*B01L 3/00* (2006.01)

(52) U.S. Cl.
CPC ... *B01L 3/502707* (2013.01); *B01L 3/502784* (2013.01); *B01L 3/5023* (2013.01); (Continued)

(58) Field of Classification Search
CPC ..... B01L 2300/0627; B01L 2300/0636; B01L 2300/0896; B01L 2300/12; B01L 2300/14
See application file for complete search history.

(56) References Cited

U.S. PATENT DOCUMENTS 6,602,414 B2 8/2003 Warner
7,192,693 B2 * 3/2007 Bryant ..... A61L 27/16 424/426

(Continued)

FOREIGN PATENT DOCUMENTS

CA 2809729 A1 3/2012
CA 2013037046 A1 3/2013

OTHER PUBLICATIONS

Chen et al, J. Controlled Release 118:65-77, 2007.*

(Continued)

*Primary Examiner* — Kevin K Hill
(74) *Attorney, Agent, or Firm* — Eugene J. Molinelli; Beusse Wolter Sanks & Maire

(57) ABSTRACT

Techniques for hydrogel microstructures with oil isolation for small reaction volumes include providing a hydrogel microstructure that has a plurality of pores and a hydrogel frame surrounding the pores. The microstructure has a volume in a range from about 1 picoliter to about 10,000 picoliters and is configured to repel an immiscible fluid. Each pore of the plurality of pores has a pore size configured to pass the target molecule in a first solution. The microstructure is contacted with the first solution, and with a second solution that includes a reactant molecule that reacts with the target molecule to produce an observable product molecule. The microstructure is encompassed with the immiscible fluid for an extended observation duration from about 1 to about 10,000 seconds, wherein the immiscible fluid does not pass into the pores but traps the product in the microstructure. The observable product molecule is measured at some time during the observation duration.

11 Claims, 23 Drawing Sheets

(52) U.S. Cl.
CPC . *B01L 2200/0673* (2013.01); *B01L 2300/069* (2013.01); *B01L 2300/0636* (2013.01); *B01L 2400/086* (2013.01)

(56) References Cited

U.S. PATENT DOCUMENTS

| | | | | |
|---|---|---|---|---|
| 8,372,287 | B2 | 2/2013 | Workman | |
| 2003/0175824 | A1 | 9/2003 | Pishko et al. | |
| 2009/0085588 | A1* | 4/2009 | Papadakis | G01N 33/5438 324/722 |
| 2010/0248979 | A1 | 9/2010 | Tam | |
| 2011/0263747 | A1* | 10/2011 | Doyle | G01N 33/54313 522/33 |
| 2013/0109596 | A1 | 5/2013 | Peterson et al. | |

OTHER PUBLICATIONS

Helgeson et al, Curr. Op. Colloid & Interface Sci. 16:106-117, 2011.*
Chapin et al, Angewandte Chemie Int. Ed. 50:2289-2293, 2011.*
Kim et al, Lab Chip 12:4986-4991, available online Aug. 15, 2012.*
Velasco et al, Small 8:1633-1642, Mar. 29, 2012.*
Um et al, Microfluid Nanofluid 5:541-549, 2008.*
Klein and Vorlop, Eur. J. Appl. Microbiol. Biotechnol. 18:86-91, 1983.*
Liu et al, Lab on a Chip 9:1301-1305, 2009.*
Atrazhev, Alexey, et al., "In-Gel Technology for PCR Genotyping and Pathogen Detection", "Analytical Chemistry", 2010, pp. 8079-8087, vol. 82, No. 19, Publisher: American Chemical Society, Published in: http://pubs.acs.org/doi/abs/10.1021/ac1013157.
Beebe, David J., et al., "Functional Hydrogel Structures for Autonomous Flow Control inside Microfluidic Channels", "Nature", 2000, pp. 588-590, vol. 404, Publisher: Macmillan Magazines Ltd., Published in: http://www.nature.com/nature/journal/v404/n6778/full/404588a0.html.
Ikami, Mai, et al., "Immuno-pillar chip: a new platform for rapid and easy-to-use immunoassay", "Lab on a Chip", 2010, pp. 3335-3340, vol. 10, Publisher: Royal Society of Chemistry, Published in: http://pubs.rsc.org/en/content/articlelanding/2010/lc/c0lc00241k#!divAbstract.
Koh, Won-Gun, and Michael Pishko, "Immobilization of multi-enzyme microreactors inside microfluidic devices", "Sensors and Actuators B", 2004, pp. 335-342, vol. 106, Publisher: Elsevier, Published in: http://www.sciencedirect.com/science/article/pii/S092540050400557X.
Lee, Andrew G., et al., "Development of Macroporous Poly(ethylene glycol) Hydrogel Arrays within Microfluidic Channels", "Biomacromolecules", 2010, pp. 3316-3324, vol. 11, No. 12, Publisher: American Chemical Society, Published in: http://pubs.acs.org/doi/abs/10.1021/bm100792y.
Liu, Jiangjiang, et al., "Controlled photopolymerization of hydrogel microstructures inside microchannels for bioassays", "Lab on a Chip", 2009, pp. 1301-1305, vol. 9, Publisher: Royal Society of Chemistry, Published in: http://pubs.rsc.org/en/content/articlelanding/2009/lc/b819219g#!divAbstract.
Love, J. Christopher, et al., "Microscope Projection Photolithography for Rapid Prototyping of Masters with Micron-Scale Features for Use in Soft Lithography", "Langmuir", 2001, pp. 6005-6012, vol. 17, No. 19, Publisher: American Chemical Society, Published in: http://pubs.acs.org/doi/abs/10.1021/la010655t.
Manage, Dammika P., et al., "A miniaturized and integrated gel post platform for multiparameter PCR detection of herpes simplex viruses from raw genital swabs", "Lab on a Chip", 2012, pp. 1664-1671, vol. 12, Publisher: Royal Society of Chemistry, Published in: http://pubs.rsc.org/en/content/articlelanding/2012/lc/c2lc40061h#!divAbstract.
Pregibon, Daniel C., et al., "Magnetically and Biologically Active Bead-Patterned Hydrogels", "Langmuir", 2006, pp. 5122-5128, vol. 22, Publisher: American Chemical Society, Published in: http://pubs.acs.org/doi/abs/10.1021/la0534625.
Pregibon, Daniel C., et al., "Multifunctional Encoded Particles for High-Throughput Biomolecule Analysis", "Science", 2007, pp. 1393-1396, vol. 315, Publisher: AAAS, Published in: http://www.sciencemag.org/content/315/5817/1393.abstract?sid=59d91e39-972f-4f16-a902-6daf87bf2d66.
ISA/US, "International Search Report & Written Opinion for the corresponding PCT app. # US2014/062474", Feb. 13, 2015, pp. 1-11.

* cited by examiner

HYDROGEL MICROSTRUCTURES WITH IMMISCIBLE FLUID ISOLATION FOR SMALL REACTION VOLUMES

CROSS-REFERENCE TO RELATED APPLICATIONS

This application claims benefit of Provisional Appln. 61/896,637, filed Oct. 28, 2013, under 35 U.S.C. §119(e).

STATEMENT OF GOVERNMENTAL INTEREST

This invention was made with government support under Grant No. EB015403 awarded by the National Institutes of Health. The government has certain rights in this invention.

BACKGROUND

Multiplexed, sensitive, and on-chip molecular diagnostic assays are useful in both clinical and research settings. Many detection strategies employ amplification schemes to achieve sensitivity by labeling surface or bead-bound targets with enzymes that turn over substrate into fluorescent or colorimetric molecules. Since a single target-binding event is reported by the enzymatic turnover of several substrate molecules, the strategy provides signal amplification. In standard amplification reactions such as the commercially available enzyme-linked immunosorbent assay (ELISA), these enzyme-assisted amplification reactions occur on microplates with net volumes on the order of 100 μl and are still considered the gold standard for protein detection. Recent studies have however been successful in further amplifying net signal and gaining up to three orders of magnitude increase in assay sensitivity by shrinking the reaction volume to concentrate the reaction products. Running reactions in nanoliter (nL, 1 nL=$10^{-9}$ liters) to femtoliter (fL, 1 fL=$10^{-15}$ liters) sized volumes such as microwells or droplets has led to significant increases in detection sensitivities. By examining thousands of reaction volumes, some of these assays have digitized signal output at the lower end of their calibration curves, enabling single-molecule detection of target-enzyme complexes.

To this end, researchers have explored a number of platforms for the creation and utilization of stable and monodisperse miniature reaction compartments. For example, femtoliter-sized microwells, which are large enough to hold a single 3-5 micron (also micrometer, μm, 1 μm=$10^{-6}$ meters) diameter bead, have been fabricated using etched optical-fiber bundles or injection molding of polymers. In other systems, similarly sized bead-filled droplets have been arrayed on hydrophobic surfaces patterned with hydrophilic wells. Individual beads with target-enzyme complexes and the enzymatic substrate solution are then confined into the compartments and sealed using mechanical force or, in more recent work, inert fluorinated oil. Meanwhile, slightly larger, picoliter (pL, 1 pL=$10^{-12}$ liters) to nanoliter-sized microwells and surfactant-stabilized droplets have been made using soft lithography and microfluidic techniques. In all of these platforms, the confined reaction volume provides significant increases in reaction sensitivity in comparison to reactions run in bulk.

It is apparent that both microwells and droplets have favorable characteristics applicable to carrying out biological assays. While microwells are physically immobilized and have well-defined boundaries dictated by the fabrication process, droplets provide a naturally aqueous environment to foster biological reactions. However, water droplets require introduction of a solid substrate (e.g. microsphere) if they are to be functionalized with biological moieties such as nucleic acids. Furthermore, liquid manipulation in and out of microwells and droplets can be challenging and often requires intricate fluidics.

SUMMARY

It is herein recognized that a platform that incorporates the favorable characteristics of microwells and droplets while reducing disadvantages by providing more flexibility in terms of biological functionalization and reagent exchange is of high value. Thus, techniques are provided for hydrogel microstructures with oil isolation for small reaction volumes that span the advantages and avoid at least some disadvantages of both droplets and microwells.

In a first set of embodiments, a hydrogel microstructure includes a plurality of pores and a hydrogel frame surrounding the pores. The hydrogel frame includes a plurality of covalently embedded molecules of a probe species selected to bind to a target molecule. The hydrogel microstructure has a volume in a range from about 1 picoliter to about 10,000 picoliters and is configured to repel an immiscible fluid. The plurality of pores have a pore size configured to pass the target molecule in solution through the microstructure for binding to the probe species.

In a second set of embodiments, an apparatus includes a hydrogel microstructure and sources of fluids and a viewing port. The hydrogel microstructure includes a plurality of pores and a hydrogel frame surrounding the pores. The hydrogel microstructure has a volume in a range from about 1 picoliter to about 10,000 picoliters and is configured to repel an immiscible fluid. Each pore of the plurality of pores has a pore size configured to pass a target molecule in a first solution through the microstructure. A first source of fluid is configured to flush the hydrogel microstructure with the first solution including the target molecule. A second source of fluid is configured to flush the hydrogel microstructure with a second solution that comprises a reactant molecule that reacts with the target molecule to produce an observable product molecule. A third source of fluid is configured to encompass the hydrogel microstructure with the immiscible fluid for an extended observation duration, wherein the immiscible fluid does not pass into the plurality of pores when the hydrogel microstructure is loaded with the second solution but traps the observable product molecule in a volume encompassed by the immiscible fluid. The observation duration is selected in a range from about 1 second to about 10,000 seconds. The viewing port is configured for observing the observable product molecule at some time during the observation duration.

In a third set of embodiments, a method includes providing a hydrogel microstructure that has a plurality of pores and a hydrogel frame surrounding the pores. The hydrogel microstructure has a volume in a range from about 1 picoliters to about 10,000 picoliters and is configured to repel an immiscible fluid. Each pore of the plurality of pores has a pore size configured to pass the target molecule in a first solution through the microstructure. The method also includes contacting the hydrogel microstructure with the first solution including the target molecule, and contacting the hydrogel microstructure with a second solution that includes a reactant molecule that reacts with the target molecule to produce an observable product molecule. The method further includes encompassing the hydrogel microstructure with the immiscible fluid for an extended observation duration, wherein the immiscible fluid does not pass into the plurality of pores when the hydrogel microstructure is loaded with the second solution but traps the observable product molecule in a volume encompassed by the immiscible fluid. The observation duration is selected in a range from about 1 second to about 10,000 seconds. The method still further includes observing the observable product molecule at some time during the observation duration.

In a fourth set of embodiments, a composition includes a hydrogel microstructure, an aqueous solution, and an immiscible hydrophobic fluid. The hydrogel microstructure includes a plurality of pores and a hydrogel frame surrounding the pores, and has a volume in a range from about 1 picoliters to about 10,000 picoliters and is configured to repel the immiscible fluid. Each pore of the plurality of pores has a pore size configured to pass a target molecule. The aqueous solution includes the target molecule and a reactant molecule that reacts with the target molecule to produce an observable product molecule. The aqueous solution occupies the plurality of pores. The immiscible hydrophobic fluid encompasses the hydrogel microstructure.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1A:
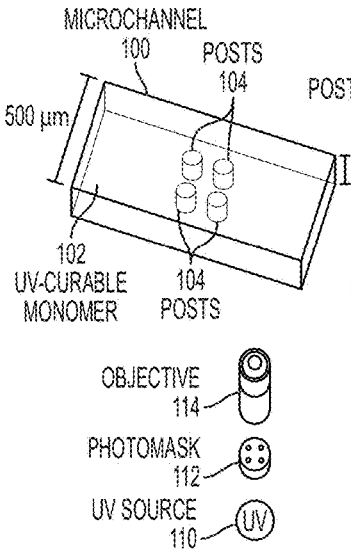
FIG. 1A is a block diagram that illustrates example fabrication of hydrogel microstructures in a microfluidic channel, according to an embodiment.

A method and apparatus are described for hydrogel microstructures with immiscible fluid isolation for small reaction volumes. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Some embodiments of the invention are described below in the context of microstructure posts affixed inside a microchannel and functionalized with covalently embedded probe molecules selected to bind to a particular target molecule and the reactions is encapsulated in a fluorinated oil phase. Some specific example reactions are described. However, the invention is not limited to this context. In other embodiments, the microstructures are freely floating microparticles, or the covalently embedded probe molecules are generic or are omitted, or other fluids immiscible with aqueous solutions are used, or other reactions that accumulate observable product molecules in aqueous solution, not otherwise described herein, are used. For example, in various embodiments, reactions include: drug-screening interactions (in which a small drug molecule interacts with some target molecule); interactions in which small molecules have high chemical tendency to stay inside gel environment; small molecule analyte sensing (such as glucose sensing, or NO2 species sensing of interest in cancer metabolism); or sensing of metabolites; or some combination. In some embodiments, the microstructures are hydrophobic, and store hydrophobic solutions, and are encapsulated by a hydrophilic fluid which is therefore "immiscible" with respect to the microstructure.

As used herein, a microfluidic channel has at least one dimension in a size range from about 0.1 micron to about 1000 microns. Similarly, a microstructure has a greatest dimension in a range from about 1 micron to about 1000 microns.

1. Overview

Hydrogels have emerged as attractive scaffolds for bioassays due to their non-fouling, flexible, and aqueous properties. A hydrogel (also called aquagel) is a network of polymer chains that are water-insoluble. A polymer is a large molecule (macromolecule) composed of repeating structural units typically connected by covalent chemical bonds. Hydrogels are highly absorbent (they can contain over 99% water) and possess a degree of flexibility due to their significant water content.

Here a novel platform is presented in which microstructure compartments are used as individually confined reaction volumes within an immiscible fluid phase. Example functional and versatile hydrogel microstructures are fabricated in microfluidic channels that are physically isolated from each other using a surfactant-free fluorinated oil phase, generating pL to nL sized immobilized aqueous reaction compartments that are readily functionalized with biomolecules. In doing so, monodisperse reaction volumes are achieved with an aqueous interior while exploiting the unique chemistry of a hydrogel, which provides a solid and porous binding scaffold for biomolecules and is impenetrable by oil. Furthermore, lithographically-defined reaction volumes are readily customized with respect to geometry and chemistry within the same channel, allowing rational tuning of the confined reaction volume on a post-to-post basis without needing to use surfactants to maintain stability.

In an example embodiment, a multiplexed signal amplification assay is designed and implemented in which gel-bound enzymes turn over small molecule substrate into fluorescent product in the oil-confined gel compartment, providing significant signal enhancement. Using short (20 min) amplification times, the encapsulation scheme provides up to two orders of magnitude boost of signal in nucleic acid detection assays relative to direct labeling and does not suffer from any cross-talk between the posts. In one example embodiment, up to 57-fold increase in nucleic acid detection sensitivity compared to a direct labeling scheme is demonstrated.

One can envision an immobilized hydrogel mesh as a hybrid between a microwell and a droplet in terms of its potential ability to act as a solid yet aqueous compartment for reactions. Lithographic techniques can be used to photopattern hydrogel microstructures with photomask-defined shapes and sizes into channels. It is additionally demonstrated how to covalently functionalize a hydrogel mesh with biological probes or other functional groups at the time of polymerization. The resulting compartment itself is chemically unique since it serves as both an immobilized aqueous reaction volume and as a fully functional mesh for physical or chemical entrapment and reaction of biological species.

Hydrogel microstructures have been previously implemented for microfluidic flow control, analyte detection, and cell encapsulation/patterning. In addition, a series of recent studies has used sub-microliter hydrogel posts as individual polymerase chain reaction ("PCR") reaction chambers. From a biological standpoint, many of the aforementioned studies have shown that the non-fouling, flexible, and solution-like nature of a hydrogel mesh renders it superior to rigid surfaces for nucleic acid capture and for immobilization of biological probe molecules. Furthermore, chemical characteristics of the gel such as porosity can be fine-tuned by adjusting the starting monomer composition.

In the illustrated embodiments, porosity-tuned polyethylene glycol (PEG) or polyethylene glycol diacrylate (PEG-DA) hydrogel posts are photopatterned into microfluidic channels using projection lithography. An array of such posts affixed to a substrate, such as the floor of a microchannel, is sometimes called a microstructure pad. FIG. 1A is a block diagram that illustrates example fabrication of hydrogel microstructures in a microfluidic channel, according to an embodiment. The example microchannel 100 is 500 microns wide and 30 microns deep, and arbitrarily long. An ultraviolet (UV)-curable monomer 102, e.g., mixed with a photoinitiator, in liquid phase flows through the microchannel 100 and is illuminated by an ultraviolet beam that originates in a UV source 110, is shaped by a photomask 112, and focused by objective lens 114 into the microchannel through a port or transparent microchannel floor. The cured monomer forms the microstructure posts 104. The liquid phase monomer 102 is then flushed out of the channel leaving the posts 104.

Figure 1B:
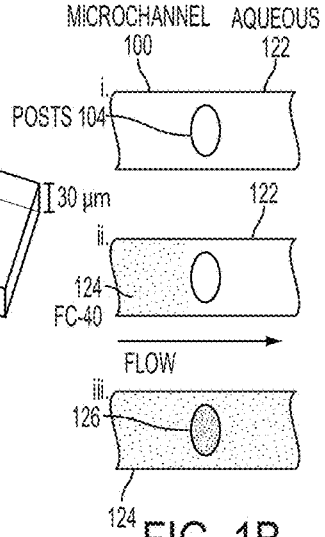
FIG. 1B is a block diagram that illustrates example successive flushing of a hydrogel microstructure with a aqueous solution followed by an immiscible hydrophobic fluid, according to an embodiment.

The illustrated embodiments demonstrate the use of such hydrogel microstructures as isolated picoliter to nanoliter sized reaction compartments within a surfactant-free fluorinated oil phase. Using pressure-driven fluidics, reagents are easily exchanged in and out of the device. The porosity of the gel is such that solutes introduced in the aqueous-phase will rapidly load into the gel post via diffusion. FIG. 1B is a block diagram that illustrates example successive flushing of a hydrogel microstructure with an aqueous solution followed by an immiscible hydrophobic fluid, according to an embodiment. FIG. 1Bi shows the distribution of solutes in an aqueous solution 122 as the light gray fill. The hydrodynamic resistance in the hydrogel microstructure relative to that of the channel ensures that effects of convection are negligible in the hydrogel microstructure, as described in more detail in a later section. The subsequent introduction of a water-immiscible fluid 124, such as a fluorinated oil phase (FC-40), into the device leads to the aqueous phase 122 being swept out of the channel 100, as depicted in FIG. 1Bii. In the process, since the oil cannot penetrate the pores of the hydrogel, it instead conformally coats the hydrogel microstructure, effectively sealing off its contents. Since there is no convective transport through the pores of the gel, the reagents inside the hydrogel microstructure are not swept out upon introduction of the oil and operate to produce one or more observable products 126, as shown in FIG. 1Biii. At the end of the process, what remains is an oil-isolated hydrogel post which can act as a confined reaction compartment. Additionally, by replacing the oil phase in the channel with a different aqueous phase containing a new solute, the hydrogel microstructure post can be re-loaded and once more re-confined, allowing for easy loading and unloading, as described in more below with reference to FIG. 8.

Figure 1C:
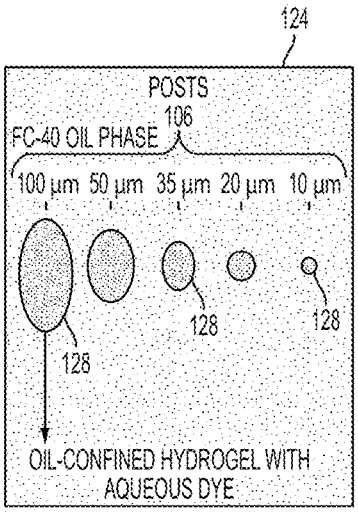
FIG. 1C is a block diagram that illustrates example entrapment of aqueous solution in multiple different sized microstructures by an immiscible fluid, according to an embodiment.

By simply changing the photomask, monomer composition, or UV exposure-time (even within the same channel), precise control is exercised over post geometry and chemistry for a range of applications, which is one unique feature of the system shown here. The post geometry accordingly dictates the volume of the isolated hydrogel compartment when an oil phase is later flushed through the channel. An example of this control is seen in FIG. 1C. FIG. 1C is a block diagram that illustrates example entrapment of aqueous solution in multiple different sized microstructures by an immiscible fluid, according to an embodiment. Hydrogel microstructure posts 106 of different sizes (10 micron diameter to 100 micron diameter) were polymerized in tandem in the same microfluidic channel. The device was filled with an aqueous food dye 128, which initially diffused everywhere in the channel and hydrogel microstructure posts 106. The FC-40 oil 124 flush then replaced the aqueous phase in the device and conformally coated the posts 106, creating post-size dependent isolated compartments that retained the food dye 128. The small pore sizes and hydrophilic nature of the hydrogel microstructure ensures that the aqueous material within the gel matrix is not displaced by the oil phase.

Thus, in various embodiments, the methodology proposed allowed creation of size-dependent reaction volumes on single chip. This provides the ability to control and vary the size of the isolated compartment as well as to control and vary the volume of water retained around it all on a single chip.

Figure 1D:
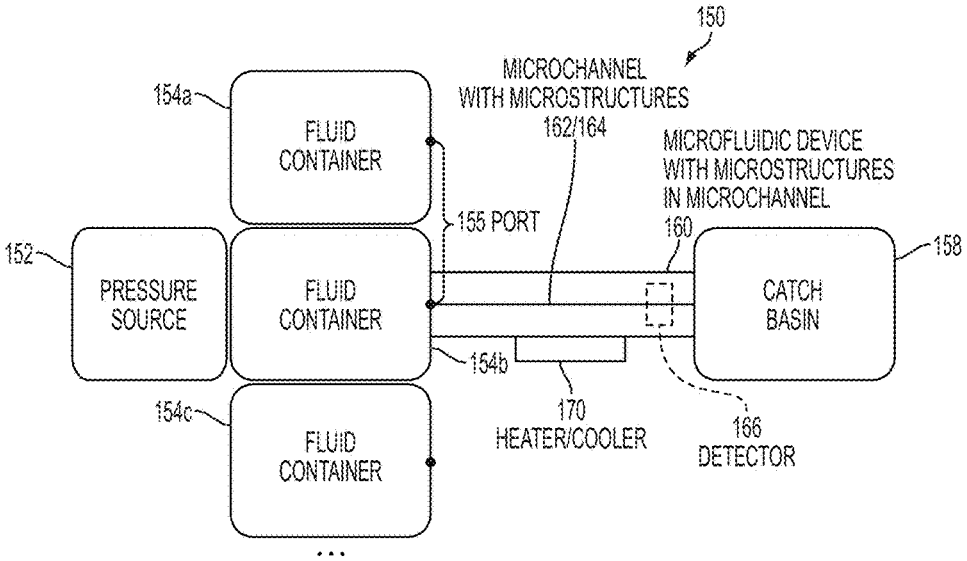
FIG. 1D is a block diagram that illustrates an example apparatus for using hydrogel microstructures with oil isolation for small reaction volumes, according to an embodiment.

FIG. 1D is a block diagram that illustrates an example apparatus 150 for using hydrogel microstructures with oil isolation for small reaction volumes, according to an embodiment. The apparatus 150 includes a microfluidic device 160 having one or more microchannels 162 in which one or more microstructures 164, such as posts 104 or posts 106, are formed and affixed. The product of reactions in the microstructures, such as one or more colorimetric or fluorescent products, is observed by detector 166, such as a photodetector or photodetector array, e.g. a charge coupled device (CCD) array. If the device is not transparent to the observations, then the device 160 includes an observation port (not shown) between the detector 166 and the microstructures 164. Fluid is introduced into the microchannel 162 from one fluid container (e.g., pipette) of a plurality of fluid containers (e.g., containers 154*a*, 154*b*, 154*c*, among others indicated by ellipses, and collectively referenced hereinafter as fluid containers 154), by pressure supplied by a pressure source 152. Fluid passes out of each container 154 into the microchannel 162 through a port 155 (e.g., pipette needle) in the fluid container 154. The fluid that passes through the microchannel is ejected into a catch basin 158. Each fluid container 154 is disposed between the pressure source 152 and the microfluidic device 160 and the fluid inside moved by the pressure source 152. The combination of fluid container 154 and pressure source 152 composes a fluid source. In some embodiments, there is a single fluid container 154 and the contents are filled from external reservoirs. In some embodiments, a gravity feed is used instead of or in addition to the pressure source 152.

Heater/cooler 170 is included in some embodiments to change the temperature during various phases of a process employing the equipment, as explained in more detail below. In some embodiments, only ambient and elevated temperatures are used; and, heater cooler 170 is a heater, such as a hotplate. In some embodiments, only ambient and reduced temperatures are used; and, heater/cooler 170 is a cooler, such as a cold finger.

Figure 2:
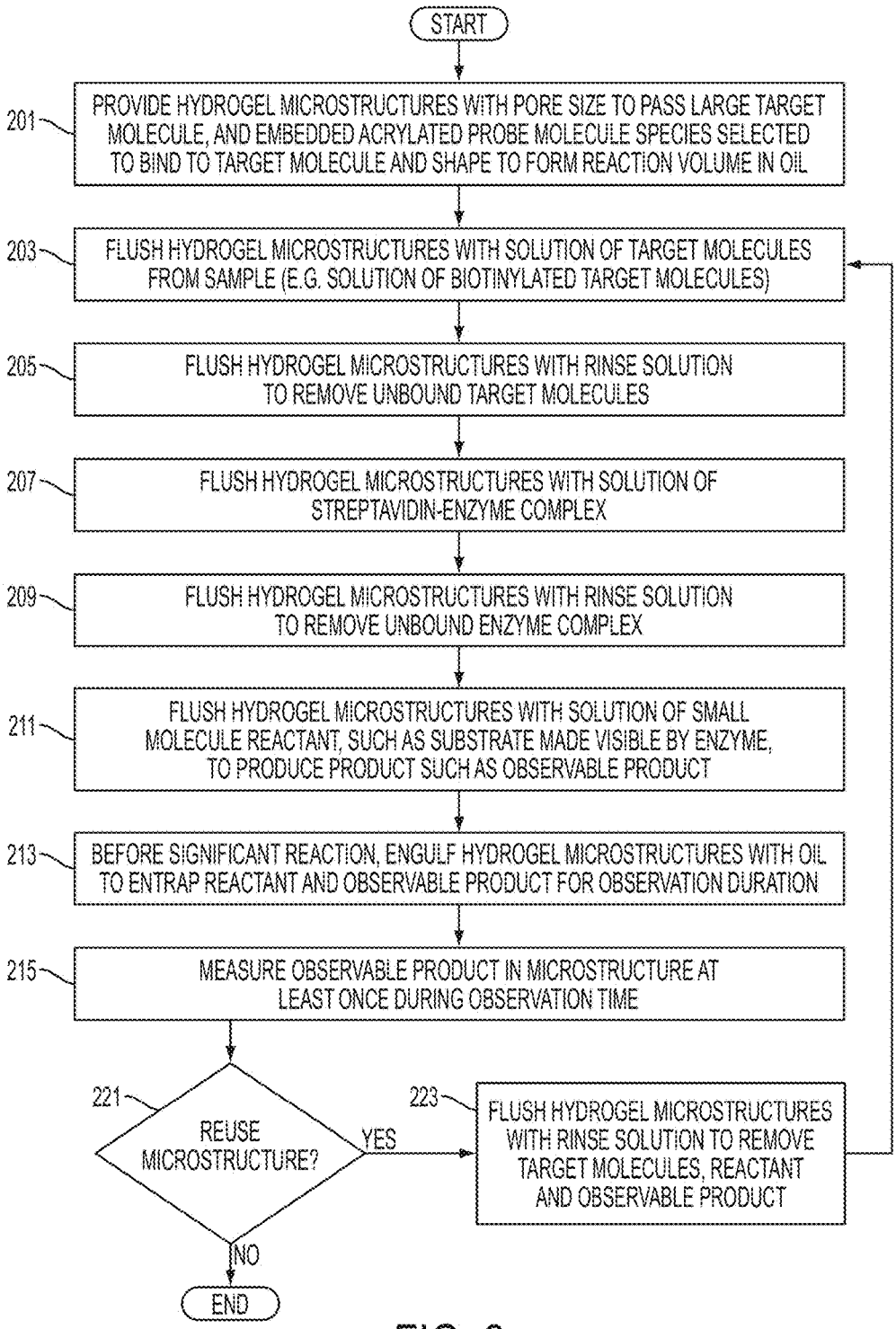
FIG. 2 is a flow diagram that illustrates an example method for using hydrogel microstructures with oil isolation for small reaction volumes, according to an embodiment.

FIG. 2 is a flow diagram that illustrates an example method for using hydrogel microstructures with oil isolation for small reaction volumes, according to an embodiment. Although steps are shown as integral blocks in a particular order for purposes of illustration, in other embodiments, one or more steps, or portions thereof, are performed in a different order, or overlapping in time, in series or parallel, or are omitted, or other steps are added, or the process is changed in some combination of ways. For example, in some embodiments, the hydrogel microstructures do not include probe molecules and all reagents diffuse into the pores from two or more aqueous solutions. In such embodiments there are no bound target molecules and step 205 to remove unbound target molecules is omitted. In some embodiments, direct labeling is used instead of enzyme-substrate labeling; and, steps 207 and 209 to bind and rinse the enzyme, respectively, are omitted. In some embodiments, the hydrogel microstructures are not reused, and steps 221 and 223 are omitted.

In step 201, one or more hydrogel microstructures, such as posts affixed to microchannels or free floating microparticles, are provided. The microstructures have pore sizes that allow reactants to pass easily throughout the microstructure, e.g., by diffusion from a stationary or flowing solution outside the microstructure. In some embodiments, at least one reactant is a large biomolecule, such as a strand of deoxyribonucleic acid (DNA) or ribonucleic acid (RNA) or a protein (a long chain of amino acids), so the pore sizes are commensurately large, such as 5 nanometers (nm, 1 nm=$10^{-9}$ meters) or more.

The pore size is related to the mesh size of the hydrogel microstructure. The mesh size of the hydrogel can be measured for a range of starting monomer concentrations—so practitioners can develop an idea of what mesh size results when a monomer composition is chosen. Some target biomolecules are bigger (in terms of molecular weight or radius of gyration) and benefit from a larger mesh. Mesh size has also been estimated by diffusing large polymers (such as dextran) into the hydrogel to understand the mesh size in terms of what molecules can diffuse freely through it. Another way to determine mesh size is by conducting swelling studies. By looking at the swelling ratio of the hydrogel in different buffers, one can use Flory-Renner polymer chemistry to back out an average mesh size.

The "average" pore size of the hydrogel ultimately depends on the volume fraction of reactive species (such as the PEG, the photoinitiator, and any covalently incorporated probe molecule species selected for binding with target molecules) and on the volume fraction of and chain length of any "porogens," which are un-reactive molecules that occupy space. So, porogens with longer chain lengths lead to "larger" pore sizes; and, higher volume fractions of the porogen also lead to larger pore sizes. The reason that it is better to do the pore size adjustment using the porogens instead of by changing volume fraction of a covalently embedded probe molecule is because introduction of a longer porogen does not change the functionalization efficiency. Reducing concentration of active species (e.g., PEG-DA), as in a typical approach for making a larger mesh, would lead to less functionalization of other acrylated species since there is lower overall reaction rate.

In some illustrated embodiments, a porogen (PEG600, that is PEG with an atomic weight of 600 Daltons) with a longer chain length is used because it is desirable for the pores to be big enough to accommodate diffusion of an enzyme used with a substrate for controlling the start of a reaction. The enzyme used in some embodiments is a large biomolecule (larger than a usual fluorophore for direct labeling).

In some embodiments, the hydrogel microstructures are pre-formed and step 201 merely involves retrieving the hydrogel microstructures from storage or other source. Once the hydrogel has been polymerized, it stays functional over long periods of time as long it is kept soaked in buffer. The buffer is typically phosphate buffered saline (PBS) or TE (Tris-EDTA). PBST stands for PBS with 0.05% Tween-20 which is a water-soluble surfactant which is sometimes used to reduce non-specific binding. Note that hydrogels themselves even stay stable in deionized water solution. The presence of the salts preserves integrity of biomolecules. So the production of the hydrogels is independent of the time that they are used, in some embodiments. In some embodiments, the hydrogel microstructures are fabricated as needed during step 201, e.g., to capture a cell, as described in more detail below.

In various embodiments, the hydrogel microstructures are fabricated with any one or mixture of two or more of the following monomers: Allyl Methacrylate; Benzyl Methylacrylate; 1,3-Butanediol Dimethacrylate; 1,4-Butanediol Dimethacrylate 745 Butyl Acrylate n-Butyl Methacrylate; Diethyleneglycol Diacrylate; Diethyleneglycol Dimethacrylate; Ethyl Acrylate 750 Ethyleneglycol Dimethacrylate; Ethyl Methacrylate; 2-Ethyl Hexyl Acrylate; 1,6-Hexanediol Dimethacrylate; 4-Hydroxybutyl Acrylate 755 Hydroxyethyl Acrylate; 2-Hydroxyethyl Methacrylate; 2-Hydroxypropyl Acrylate; Isobutyl Methacrylate; Lauryl Methacrylate 760 Methacrylic Acid; Methyl Acrylate; Methyl Methacrylate; Monoethylene Glycol; 2,2,3,3,4,4,5,5-Octafluoropentyl Acrylate 765 Pentaerythritol Triacrylate; Polyethylene Glycol (200) Diacrylate; Polyethylene Glycol (400) Diacrylate; Polyethylene Glycol (600) Diacrylate; Polyethylene Glycol (200) Dimethacrylate 770 Polyethylene Glycol (400) Dimethacrylate; Polyethylene Glycol (600) Dimethacrylate; Stearyl Methacrylate; Triethylene Glycol; Triethylene Glycol Dimethacrylate 775 2,2,2-Trifluoroethyl 2-methylacrylate; Trimethylolpropane Triacrylate; Acrylamide; N,N-methylene-bisacryl-amide; Phenyl acrylate 780 Divinyl benzene.

For those monomers that are photo-polymerizable, a photoinitiator species is included in the monomer stream to enable the polymerization process. Effectively any chemical that can produce free-radicals in the fluidic monomer stream as a result of illumination absorption can be employed as the photoinitiator species. There are in general two classes of photoinitiators. In the first class, the chemical undergoes uni-molecular bond cleavage to yield free radicals. Examples of such photoinitiators include Benzoin Ethers, Benzil ketals, a-Dialkoxy-acetophenones, a-Amino-alkylphenones, and Acylphosphine oxides. The second class of photoinitiators is characterized by a bimolecular reaction where the photoinitiator reacts with a coinitiator to form free radicals. Examples of such are Benzophenones/amines, Thioxanthones/amines, and Titanocenes (vis light).

A non-exhaustive listing of a range of photoinitiators that can be employed with a photo-polymerizable monomer for hydrogel microstructure synthesis include: Trade Name (CIBA) Chemical Name IRGACURE 184 1-Hydroxy-cyclohexyl-phenyl-ketone; 800 DAROCUR 1173 2-Hydroxy-2-methyl-1-phenyl-1-propanone IRGACURE 2959 2-Hydroxy-1-[4-(2-hydroxyethoxyl)phenyl]-2-methyl-1-propanone; DAROCUR MBF Methylbenzoylforniate IRGACURE 754 oxy-phenyl-acetic acid 2-[2 oxo-2 phenyl-acetoxy-ethoxy]-; 805 ethyl ester and oxy-phenyl-acetic 2-[2-hydroxy-ethoxy]-ethyl ester; IRGACURE 651 Alpha, alpha-dimethoxy-alpha-phenylacetophenone IRGACURE 369 2-Benzyl-2-(dimethylamino)-1-[4-(4-morpholinyl)phenyl]-1-butanone; 810 IRGACURE 907 2-Methyl-1-[4-(methylthio)phenyl]-2-(4-morpholinyl)-1-propanone; DAROCUR TPO Diphenyl(2,4,6-trimethylbenzoyl)phosphine oxide IRGACURE 819 Phosphine oxide, phenyl bis (BAPO) (2,4,6-trimethyl benzoyl); and, 815 IRGACURE 784 Bis(eta 5-2,4-cyclopentadien-1-yl) Bis[2,6-difluoro-3-(1H-pyrrol-1-yl)phenyl]titanium IRGACURE 250 Iodonium, (4-methylphenyl) [4-(2-methylpropyl)phenyl]-hexafluorophosphate(1-).

In some embodiments, the hydrogel microstructures are fabricated affixed to a structural substrate. In various embodiments, the structural substrates are one or more of the following: a glass slide, a PDMS microchannel; a Norland optical adhesive (NOA81) channel; a glass capillary; a thermoplastic polymer chips (such as Zeonex 690R); and, similar structural substrates. In other embodiments, the hydrogel microstructures are free-floating particles. Such particles may be generated using photo polymerization on a substrate with oxygen permeability, such as a polydimethylsiloxane (PDMS) substrate or PDMS coated glass slide.

In some example embodiments, the hydrogel microstructures are cylindrical posts affixed to the structural substrate, with a circular cross section; but in other embodiments other shapes are used. The different shapes have different effects on the shape of the aqueous solution external to the hydrogel microstructure that is encapsulated by the flowing oil phase, as described in more detail below with reference to FIG. 13. The encapsulated aqueous solution external to the hydrogel microstructure is used in some embodiments as an external reservoir of the solution to provide a steady flow of solute for a reaction volume within the hydrogel microstructure. A shaped external reservoir is also an advantage, for example, if some solute resists entering the hydrogel for chemical reasons. Then, tailoring shape to retain a reservoir of known volume enables delivery of the solute to the vicinity of the hydrogel. In some embodiments, pinning liquids to a structure is itself valuable. Certain shapes (such as a tear-drop shape) lend themselves to more predictable encapsulation profiles due to streamlines of liquids that flow around such shapes.

In some embodiments, molecules of a probe species are covalently embedded in the hydrogel microstructure. The function of the probe species is to bind to a target molecule in a sample to capture and retain the target molecule in the hydrogel microstructure for reaction or observation. The probe molecule species is often a large biomolecule, such as a strand of DNA complementary to at least a portion of a target DNA strand. Covalently binding the probe species is advantageous, especially when the pore size (e.g., to allow the target DNA strand) is large compared to the probe species (e.g., a DNA strand complementary to a small fraction of the target DNA strand), so that the probe species does not migrate out of the microstructure through the large pores. In some embodiments, the probe molecule is covalently bound to the hydrogel polymers during formation of the hydrogel microstructure by including an acrylate group on the probe molecule. Another method to embed the probe molecule covalently includes using a different functional group (e.g., acrylamide instead of acrylate) because any functional group with a double bond will incorporate with some efficiency into the hydrogel. In some embodiments, the hydrogel is functionalized after synthesis but before exposing to a target molecule. For example, the hydrogel initially is polymerized with something like acrylic acid in the monomer solution—which leads to the incorporation of COOH groups in the hydrogel. There are then chemicals which enable linkages between COOH and $NH_2$ groups. DNA probes can be purchased with $NH_2$ modifications, and proteins already contain $NH_2$ groups on their side chains. In some embodiments, a maleimide linkage is utilized. In such embodiments, an acrylate-functionalized maleimide group is incorporated into the hydrogel. Then a probe is procured with sulfide modification and most proteins contain sulfides due to cysteine residues. In some embodiments, biotin-streptavidin linkages are used to functionalize the gel. In such embodiments, biotins are polymerized into the gel. The probe molecule is modified with streptavidin; and, all biotin sites that do not react with the probe are subsequently blocked before exposing to the target molecule in a sample.

In some embodiments, step 201 includes flushing the hydrogel microparticles with an solution that includes a chemical to reduce binding sites in the hydrogel itself to make the microstructures more hydrophilic and thus reduce non-specific binding of probe or target molecules. For example, in some embodiments the hydrogel microstructure are flushed with a solution including potassium permanganate (KMnO4) during step 201.

In step 203, the hydrogel microstructures are flushed with an aqueous solution that contains the target molecules. During step 203, the target molecules diffuse into the pores of the hydrogel microstructure, as demonstrated in more detail in a later section. In various embodiments, step 203 is performed at an elevated or reduced or changing temperature compared to ambient temperature, using heater/cooler 170. In some embodiments, the target molecules are the largest of two or more reactants, which take the longest to diffuse into the inner pores of the hydrogel microstructure. In some embodiments, the target molecules are the constituents to be detected in a sample by an assay that uses the hydrogel microstructures, such as a DNA strand including a particular sequence or an RNA strand or a protein or shorter polypeptide. In embodiments that use a covalently embedded probe molecule species, the target molecule binds to the probe molecule and becomes captured and retained in the hydrogel microstructure during step 203. In embodiments, that use an enzyme-substrate reaction to label the target molecule, the target molecule includes a portion that will bind strongly to the enzyme. For example, exploiting the high affinity of the biotin-streptavidin reaction, the target molecule is biotinylated in some embodiments. In other embodiments, the target molecule includes a streptavidin group and the enzyme includes the biotin. As will be demonstrated below, embodiments that use an enzyme-substrate reaction to label the target molecule can produce stronger signals than obtained by directly labeling each target molecule with a single labeling molecule.

In other embodiments, a probe molecule contains a "labeling" sequence. So the sequence embedded in the hydrogel is a probe-label region complex. The probe part of this molecule binds to the target (unlabeled in this case). The label-region binds to a different biotinylated sequence that is introduced later and the target molecule is glued to this labeling sequence using a DNA ligase. Gluing them together makes the whole complex stable. In embodiments where the there is NO target but only the labeling sequence bound, the labeling sequence gets rinsed off. Then, the streptavidin-conjugated enzyme is added. In some embodiments click chemistry is used. In such embodiments, the target molecule contains one component necessary for the interaction, and the enzyme contains the other one. In embodiments directed to protein interactions, a reporting antibody that directly contains the conjugated enzyme or contains a biotin is used. In such embodiments, a capture antibody or a capture aptamer is immobilized into the hydrogel. An unlabeled target binds to the capture molecule. Then, the target is labeled using what is called a reporter antibody or reporter aptamer. This reporting molecule is either biotinylated or already conjugated to the enzyme.

In step 205, the hydrogel microstructures are flushed with an aqueous rinse solution that carries away unbound target molecules. In various embodiments, step 205 is performed at an elevated or reduced or changing temperature compared to ambient temperature, using heater/cooler 170. In some embodiments, step 205 is omitted. For example, in embodiments without embedded probe molecules, the target molecules are not bound and the unbound target molecules are used in the process; therefore, the unbound target molecules should not be removed. In embodiments when even unbound target molecules contribute to the desired signal, it is also undesirable to rinse them away; and step 205 is omitted in some of these embodiments. In some embodiments, multiple target molecules or probe molecules or samples are used, and step 203 alone or steps 203 and 205 together, are repeated as often as desired until the microstructures are fully loaded with target and probe molecules.

In step 207, the hydrogel microstructures are flushed with an aqueous solution that contains the enzyme for the enzyme substrate reaction forming a complex with a group that will bind to the target molecule. For example, the aqueous solution includes a streptavidin-enzyme complex to bind to the biotinylated target molecule. During step 207, the enzyme complex molecules diffuse into the pores of the hydrogel microstructure, and bind to the target molecules therein. Enzyme amplification can be used with any target molecule type, because the amplification depends on labeling with an enzyme and then adding a substrate. While the illustrated embodiments below use DNA biotinylated for binding to the enzyme, enzyme amplification can also be used with protein detection (capture protein, label with biotinylated antibody or aptamer and then finally with enzyme) or with other RNA sequences (such as miRNA or mRNA). Example enzymes introduced into the microstructures via aqueous solution include horse radish peroxidase (HRP) and alkaline phosphatase (AP) and B-galactosidase, among others. In embodiments that do not use an enzyme-substrate reaction to label the target molecule, step 207 is omitted. In various embodiments, step 207 is performed at an elevated or reduced or changing temperature compared to ambient temperature, using heater/cooler 170.

In step 209, the hydrogel microstructures are flushed with an aqueous rinse solution that carries away unbound enzyme complex molecules. In various embodiments, step 209 is performed at an elevated or reduced or changing temperature compared to ambient temperature, using heater/cooler 170. In some embodiments, step 209 is omitted. For example, in embodiments that do not utilize an enzyme-substrate reaction to label the target molecule, step 209 is omitted.

In step 211, the hydrogel microstructures are flushed with an aqueous solution that contains a small molecule reactant that reacts with the molecules already in the pores of the hydrogel microstructure to produce a desired product. In various embodiments, step 211 is performed at an elevated or reduced or changing temperature compared to ambient temperature, using heater/cooler 170. During step 211, the reactant molecules diffuse into the pores of the hydrogel microstructure, and begin to react with the molecules therein. In embodiments that use direct labeling, the reactant is a label that becomes observable when bound to the target molecule, and is not usually a small molecule. In embodiments that use an enzyme-substrate reaction to label the target molecule, the reactant is the substrate. As long as there is substrate available, each enzyme continues to convert substrate molecules to observable product molecules. In this way, many observable product molecules are produced for each target molecule, provided there is substrate available. Thus, the signal is amplified over the signal from one label per target molecule that results from direct labeling. However, a smaller signal is produced if the substrate leaks out of the microstructure. In additions, the amplified signal can leak away if the observable product is not confined to the microstructure. This also causes cross-talk between different posts, because what leaks out of one post can find its way into another post.

Example colorimetric substrates used with HRP include: 5-bromo, 4-chloro, 3-indolylphosphate (BCIP)/Nitro-Blue Tetrazolium (NBT); ABTS (2,2'-Azinobis[3-ethylbenzothiazoline-6-sulfonic acid]-diammonium salt); OPD (o-phenylenediamine dihydrochloride) [HRP]; MB (3,3',5,5'-tetramethylbenzidine); and 3-3' diaminobenzidine tetrachloride. Example colorimetric substrates used with AP include p-Nitrophenyl Phosphate. Example colorimetric substrates used with B-galactosidase include 5-Bromo-4-Chloro-3-Indolyl β-D-Galactopyranoside. Instead of or in addition to colorimetric substrates, fluorescent substrates are used in some embodiments. Example fluorescent substrates used with HRP include amplex red (7-Hydroxy-3H-phenoxazin-3-one 10-oxide) which gets turned over to resorufin-sold by Life Technologies; and QuantaBlu Fluorogenic Peroxidase Substrate-sold by Thermo Scientific. Example fluorescent substrates used with AP include 2'-[2-benzothiazoyl]-6'-hydroxybenzothiazole phosphate [BBTP]—sold by Promega. Example fluorescent substrates used with B-galactosidase include Resorufin-B-galactopyranoside (RGB, Life Technologies); fluorescein-di-B-galactopyranoside (FDG, Life Technologies); and, 4-Methylumbelliferyl β-D-Galactopyranoside (MUG) 9H-(1,3-Dichloro-9,9-Dimethylacridin-2-One-7-yl) β-D-Galactopyranoside. In some embodiments, chemiluminescence substrates are used, such as ELISA HRP Substrates Crescendo and Forte from Luminata™, and NovaBright substrates and Galacton Star substrates from Life Technologies™.

In step 213, before significant signal is lost, the hydrogel microstructures are engulfed in an immiscible fluid, e.g., a hydrophobic fluid, such as an oil, that cannot enter the pores of the microstructure. The immiscible fluid is made to flow in order to entrap reactant and observable product in the volume encompassed by the immiscible fluid for a time period called an observation duration. In various embodiments, step 213 is performed at an elevated or reduced or changing temperature compared to ambient temperature, using heater/cooler 170.

A significant reaction is one in which some signal is obtained which is differentiable from background noise. Typically, this means that the signal divided by the noise generated by the assay is greater than 3—a widely accepted criterion in this field. The target concentration at which this ratio hits 3 is known based on a calibration curve that is generated. In example embodiments described below for DNA sequences, the target concentration at which the ratio hit 3 was reached between 200 femtoMolar (fM, 1 fM=$10^{-15}$ Molar) and 500 fM of DNA target. In other embodiments, this all differs based on the incubation conditions, the reaction times, and the types of probes/targets and the affinity between them.

In some embodiments, reactants are selected or combined to slow down initial reaction to provide sufficient time for encapsulation by the immiscible fluid phase. For example, a reactant is selected that first changes form before reacting or an inhibitor is combined with the reactant to slow the initial reactions. In some embodiments, for the enzyme concentrations used, Resorufin-B-galactopyranoside (RGB, Life Technologies) and fluorescein-di-B-galactopyranoside (FDG, Life Technologies) were both considered as potential substrates and the substrate RGB turned over faster than FDG. In some embodiments, the enzyme concentration is adjusted, or other conditions of the reaction are changed, to trap the product that RGB turns into.

In various embodiments, one or more of the following oils are used as the immiscible or hydrophobic fluid: Fluoroinert-40 (FC-40); Fluoroinert-80 (FC-80); DuPont Krytox fluorinated oils; HFE-7500 (fluorinated oil); Perfluorodecalin; Mineral oil; Corn Oil; Soybean oil; and Silicone Oil. In some embodiments, e.g., with hydrogel microparticles, the oil is used with surfactants to produce emulsions. In various embodiments, the surfactants used include one or more of surfactants from RAN Biotechnologies; Span-80; and, Abil-EM-90. Within the observation duration, the signal accumulates, especially using the enzyme-substrate reaction.

In embodiments using microparticles, step 213 includes flowing the aqueous solution with microparticles into the oil and providing kinetic energy, such as in a vortex, centrifuge, shaker, pipetting, or ultrasound to emulsify the aqueous solution sufficiently to form oil encapsulated hydrogel microparticles. Typically, the average size of droplets in an emulsion depends on the ratio of surface tension between the oil/water phase with respect to the viscous stresses that the droplet feels—this ratio is defined in a dimensionless group known as the capillary number. As more energy is put into a system, the droplet size becomes smaller. When hydrogel particles are added in this mixture, there is a finite length scale provided by the particle which dictates the minimum size of the resulting droplet. Thus, by adding enough energy into the system, one is able to produce a particle containing droplet which has the same dimensions as the particle.

In step 215 a measurement is made of the observable product during the observation duration while the hydrogel microstructure with aqueous solution in its pores is engulfed or otherwise encompassed in the immiscible fluid. In various embodiments, step 215 is performed at an elevated or reduced or changing temperature compared to ambient temperature, using heater/cooler 170. If the first reaction product from step 211 is not the final desired product, then step 215 is delayed, and steps 211 and 213 are repeated with the next reactant until the final product is produced. When the final product is an observable product, then step 215 is performed when the final product is produced. If the final product is not an observable product, but simply a reaction product, such as a modified protein, then the reaction product is collected from the hydrogel microparticles, e.g., in another rinse, during step 215.

In step 221, it is determined whether the hydrogel microstructure is to be reused, e.g., to host another reaction with a new sample where a probe molecule species is not embedded in the hydrogel microstructure. If so, then in step 223, the hydrogel microstructures are flushed with an aqueous rinse solution that carries away molecules in solution in the pores of the hydrogel microstructure. Step 203 and following steps are then executed again to load the pores with the target molecule and any enzymes or reactants involved in a protocol being implemented.

2. Example Embodiments

In various embodiments, this novel concept of oil-encapsulation of a hydrogel microstructure is applied to design a confined-volume enzymatic amplification reaction which occurs entirely on-chip. Porosity-adjusted gel posts are fabricated with covalently embedded biological probes. The pore size is tuned such that large (>500 KDa) biomolecules can diffuse and react freely through the hydrogel matrix. A biotinylated probe is used to characterize the system and to design the enzymatic assay workflow. The oil-flush is shown to be advantageous for signal retention inside the hydrogel. It is also shown that there is no appreciable post-to-post crosstalk. Furthermore, a multiplexed nucleic acid assay is designed in which DNA probes embedded in the hydrogel posts are hybridized with the complementary target, labeled with enzyme, loaded with a small molecule substrate in an aqueous phase, and immediately isolated using oil allowing the amplification reaction to occur in a physically confined aqueous gel compartment within the oil phase. The resulting product molecules are insoluble in the oil and instead accumulate in the isolated hydrogel post volume. The confined volume therefore allows for increase in effective concentration of the fluorescent small molecule product, leading to almost 2 orders of magnitude boost in net signal with short (20 min) amplification times relative to a direct labeling scheme at low (10 pM) target concentrations. Up to 57-fold increase in limit of detections is achieved and a linear response is observed over 2.5 orders of magnitude using the platform.

Materials and Methods

Device Fabrication & Surface Activation

Straight polydimethylsiloxane ("PDMS") (Sylgard) microchannels were fabricated using soft lithography. Channel inlets and outlets were punched using a 15-gauge Luer stub and channels were sonicated in ethanol and dried with argon gas prior to use. Glass slides (VWR, 24×60 mm) were soaked for 1 hour in a 1 M NaOH bath, rinsed with DI water, and dried using argon gas. The PDMS channels and glass slides were plasma-treated (Harrick) on medium RF for 25 seconds, bonded together, and heated at 80 C for 20 minutes. In order to ensure adhesion of hydrogel posts to the glass, channels were then treated with 2% (v/v) solution of methacryloxypropyl trimethoxysilane (TPM, from Sigma). The TPM solution was prepared in 25% (v/v) phosphate buffered solution ("PBS") in ethanol pH adjusted to 5. The channels were then rinsed & sonicated in ethanol, and cured at 80 C for 20 minutes. Before usage, devices were once more rinsed and sonicated in ethanol.

Hydrogel Post Polymerization

A photomask with desired post shape was placed in the field-stop of an inverted microscope (Zeiss Axio Observer A1). The device was filled with monomer solution using a pipette and aligned on the microscope stage using a charged-coupled device ("CCD") (Andor Clara). Posts used for bioassays were UV-polymerized for 85 ms through a 20× microscope objective. (Zeiss Plan-Neofluar, NA=0.5) Exposure time was controlled using an external shutter (Sutter). After each round of polymerization, the channel was rinsed using 1×PBS and filled with the subsequent monomer solution. Biological probes were purchased from IDT with an acrydite modification to allow covalent copolymerization into the hydrogel.

In some embodiments, monomer solutions were prepared using the following reagents:

Polyethylene Glycol Diacrylate, MW=700 (PEG-DA-700, Sigma)

Polyethylene Glycol, MW=600 (PEG-600)

Darocur-1173 (Sigma)

3× Tris-EDTA Buffer (3×TE)

For bioassays, the monomer solution was composed as follows:

20% PEG-DA-700

40% PEG-600

5% darocur-1173

35% 3×TE with green food dye

This monomer solution was thoroughly vortexed and centrifuged (6000 rpm) for 15 minutes before use. It was then mixed in a 9:1 ratio with the biological probe aliquot.

Biotinylated DNA aliquots were stored at either 50 μM or 5 μM in 1×TE. All DNA probe aliquots were stored at 1 mM in 1×TE. The DNA probe and target sequences used in this study are shown in Table 1 and were all ordered from Integrated DNA Technologies (IDT).

TABLE 1

Example DNA probe and target sequences.

| SEQ ID NO | | |
|---|---|---|
| 1 | Biotinylated DNA | 5'/Acryd/ATA GCA GAT CAG CAG CCA GA/Bio/3' |
| 2 | DNA Probe 1 | 5'/Acryd/ATA GCA GAT CAG CAG GCA GA/3' |
| 3 | DNA Probe 2 | 5'/Acryd/CAC TAT GCG CAG GTT CTC AT/3' |
| 4 | DNA Probe 3 | 5'/Acryd/GTA CCC ACG TCT AGC ATA GC/3' |
| 5 | DNA Target 1 | 5'/Bio/TCT GCC TGC TGA TCT GCT AT/3' |
| 6 | DNA Target 2 | 5'/Bio/ATG AGA ACC TGC GCA TAG TG/3' |
| 7 | DNA Target 3 | 5'/Bio/GCT ATG CTA GAC GTG GGT AC/3' |

Assay Workflow

Prior to running bioassays, channels were filled with a 3% (v/v) solution of Pluronic F-108 (Sigma) in nuclease-free water (Affymetrix) for 1 hour to block the glass and the gel posts. Streptavidin-β-galactosidase (SAB) was diluted in PBS with 0.2% (v/v) Tween-20 (PBST) and filtered through a 0.2 μm syringe filter prior to use. All DNA targets were diluted in 1×PBS. All incubations occurred under a 1 psi pressure-driven flow at a final flow-rate of 10 μL/min. A 1 mL syringe (BD) with the plunger removed was connected to tygon tubing, which was then used to connect to house air through a pressure gauge (0.2-25 psi outlet range, Controlair, Inc.). After each incubation step, the channel was rinsed using a 300 μL volume of PBST. The final two steps of the enzymatic reaction were done using a hand-held 1 mL syringe fitted with a cut 200 μL pipette tip on the end. Fluorescein-di-β-galactopyranoside (FDG) was always diluted into phosphate buffered saline with Tween 20 ("PBST") to a final concentration of 200 μM and flowed through the device for 15 seconds. This was immediately followed by a 10 second flush with fluorinated oil (FC-40, Sigma). All imaging was done using fluorescence or bright field microscopy using a 10× objective (Zeiss Plan-Neofluar, NA=0.3). Images were analyzed by averaging signal over the post area.

Assay Development

Unless otherwise specified, the illustrated biological studies were done using cylindrical posts with a radius of 75 μm prepared using polyethelene glycol ("PEG")-diacrylate based monomer solutions that were developed and optimized by our group for multi-step hydrogel-based bioassays requiring reaction and diffusion of large (>500 KDa) biomolecules. It is possible to tune the pore size of the mesh by changing relative concentrations of the active crosslinking species (PEG-diacrylate), the photoinitiator, and the porogen (PEG-200 or PEG-600). Porogens with larger molecular weights lead to a hydrogel frame (also called matrix or network or mesh or scaffold, herein) with higher average porosity without reducing functionalization of biological molecules into the matrix. The monomer mixture described above gave the example hydrogels a mesh size of up to hundreds of nanometers. The monomer chemistry also dictates the functionalization efficiency of acrylate-modified biological species. Hydrogels that are more tightly crosslinked incorporate higher concentrations of biological probes, but also have smaller pore sizes and reduced diffusion through the hydrogel, leading to a trade-off. The chemistry used here leads to the incorporation of acrylate-bearing nucleic acid probes into the hydrogel matrix with an efficiency of ~10% under the described synthesis conditions. By simply exchanging the monomer in the device after each round of synthesis, posts bearing different biological functionalities (e.g. DNA sequences) are polymerized within the same device in some embodiments. Straight microfluidic channels were used to enable a streamlined workflow with respect to reagent exchange through the device although the workflow is amenable with a wide range of microfluidic geometries in other embodiments. Here, the chip was interfaced with a pressure-controlled flow system as described in previous work and diagrammed schematically in FIG. 1D, described above.

Figure 3A:
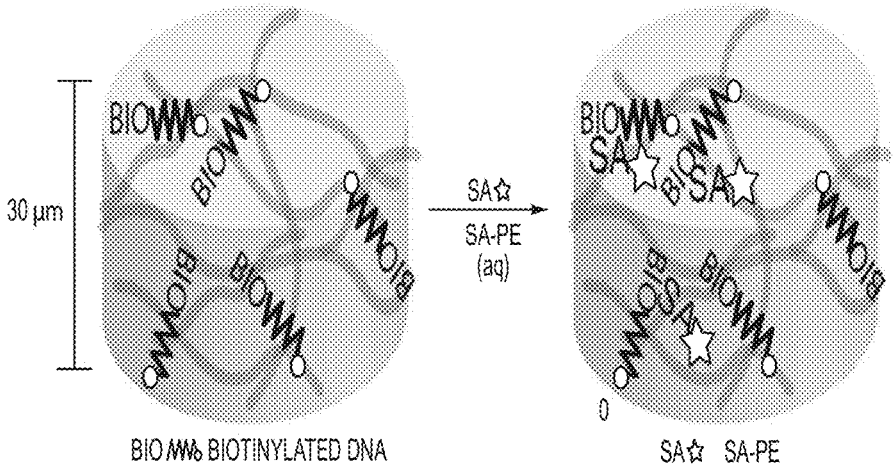
FIG. 3A is a block diagram that illustrates an example microstructure post fixed to a microchannel and configured to directly label covalently embedded DNA in a small reaction volume, according to an embodiment.

Reagent delivery and target incubation conditions were optimized using immobilized hydrogel microstructure posts (abbreviated gel posts hereinafter) functionalized with biotinylated DNA for facile attachment of streptavidin-conjugated species as shown in FIG. 3A. FIG. 3A is a block diagram that illustrates an example microstructure post fixed to a microchannel and configured to directly label covalently embedded DNA in a small reaction volume, according to an embodiment. The covalently embedded probes are biotinylated DNA, and the direct label is streptavidin (SA) phycoerythrin (PE) complex.

Analytes were delivered in a flow-through format where it is important to eliminate any mass-transfer limitation imposed by the delivery rate of the analyte to the surface of the gel posts. By using a high Péclet number (Pe>1E4) flow in the device, as described in more detail below, it is ensured that the analyte concentration at the surface of the post are constantly equivalent to the bulk concentration, making any resulting depletion zone negligible. The potential diffusional limitation imposed by the hydrogel network were also considered. Biological species such as nucleic acids and proteins diffusing and reacting within similar gel networks have a high (>50) Dahmköhler number, often leading to a reaction boundary layer around the gel. However, given enough time, the target molecules diffuse into and react with all parts of a porosity-adjusted hydrogel.

Figure 3B:
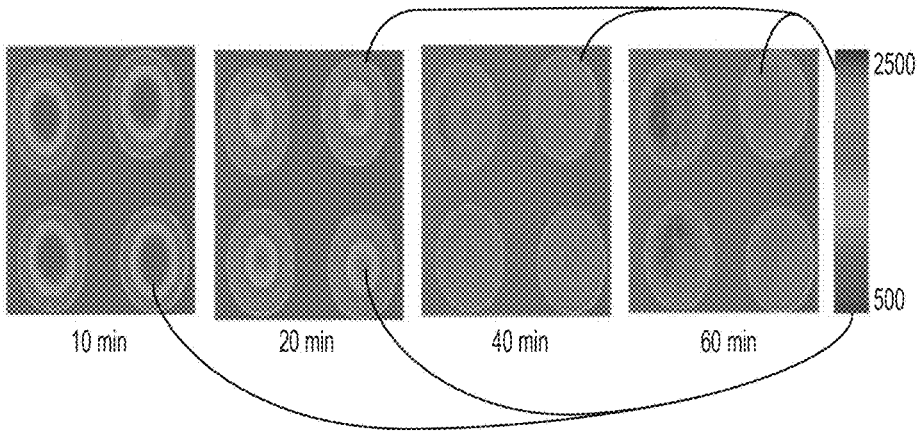
FIG. 3B is a series of images that illustrate example increased signal with time of four microstructure posts in a microchannel configured as depicted in FIG. 3A, according to an embodiment.

Both of these assay aspects were tested using 2 ng/μL streptavidin-phycoerythrin (SA-PE, Life Technologies), a 300 KDa fluorophore. FIG. 3B is a series of images that illustrate example increased signal with time of four microstructure posts in a microchannel configured as depicted in FIG. 3A, according to an embodiment. By imaging progression of the reaction under flow over time, at 10 minutes, 20 minutes, 40 minutes and 60 minutes after encapsulation oil, it was verified that there was no formation of depletion zones around the gel posts and that the gel did not interact significantly with the fluorophore. Diffusion and reaction of the fluorophore into the gel over time was clearly observed until the gel was saturated with the fluorophore at 60 minutes. As expected, the outermost section of the gel saturates first, but over the time course of 60 minutes, reaction was observed throughout the entire gel post.

Figure 9A:
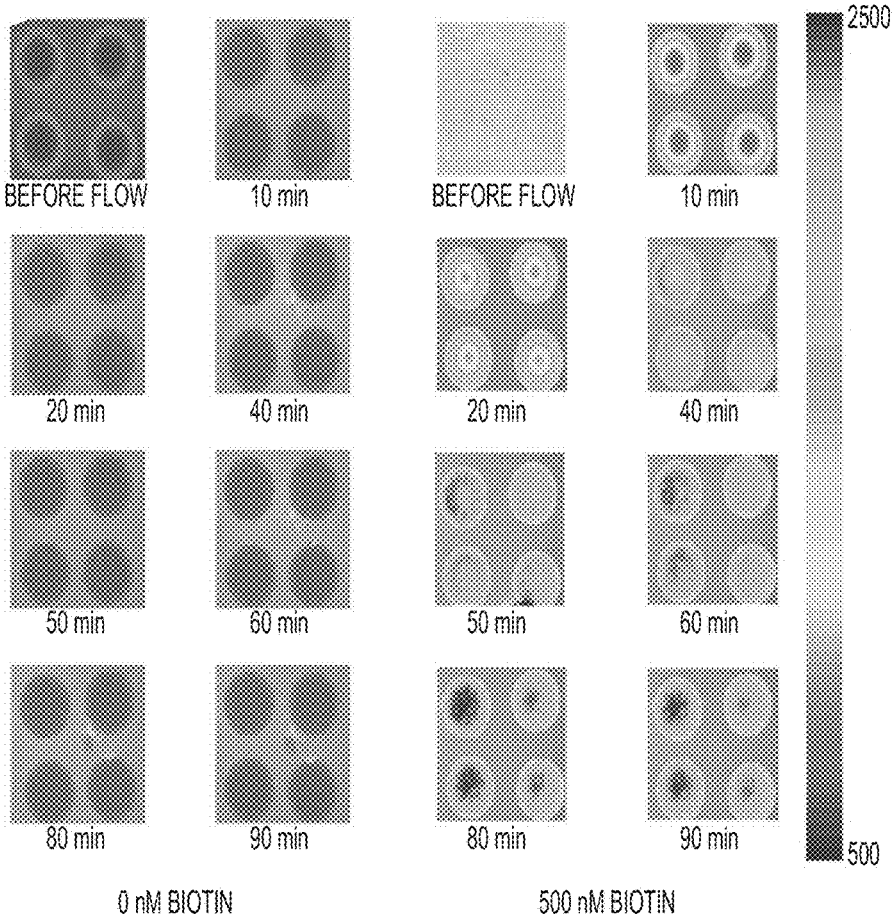
FIG. 9A is a series of images that illustrates example effect of directly labeling a covalently embedded probe molecule in the hydrogel microstructure, according to an embodiment.
Figure 9B:
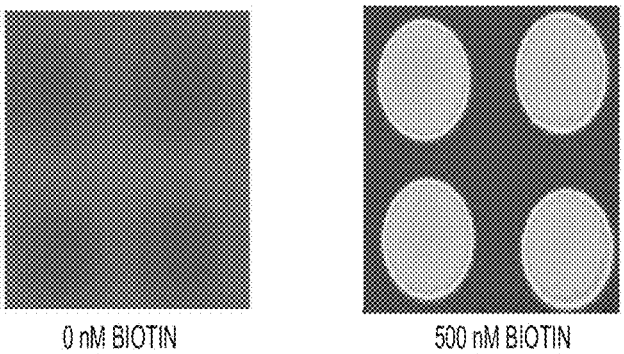
FIG. 9B is a pair of images that illustrates example effect of rinsing directly labeled microstructures having covalently embedded probe molecules, according to an embodiment.

Furthermore, fluorophore binding was only observed on biotin-functionalized posts. FIG. 9A is a series of images that illustrates example effect of directly labeling a covalently embedded probe molecule in the hydrogel microstructure, according to an embodiment. The fluorophore diffuses into the pores and is captured by the biotinylated embedded probes, but is not concentrated in the gel posts without biotin. The channel was then rinsed using PBST for evaluation of the posts at the conclusion of the assay. FIG. 9B is a pair of images that illustrates example effect of rinsing directly labeled microstructures having covalently embedded probe molecules, according to an embodiment. The fluorophore sticks to the biotinylated embedded probe and is nearly absent in the post without the biotin.

Post-to-post monodispersity and uniformity of functionalization was assessed after labeling. All four posts remained the same size (radius of 75 μm) after the assay; the average signal was 1200 arbitrary units; and a coefficient-of-variation in fluorescence signal from post-to-post was calculated to be <5%. These initial assays thus allowed the characterization of the fundamental aspects of the system and to also optimize parameters such as flow-rates and incubation times.

Figure 3C:
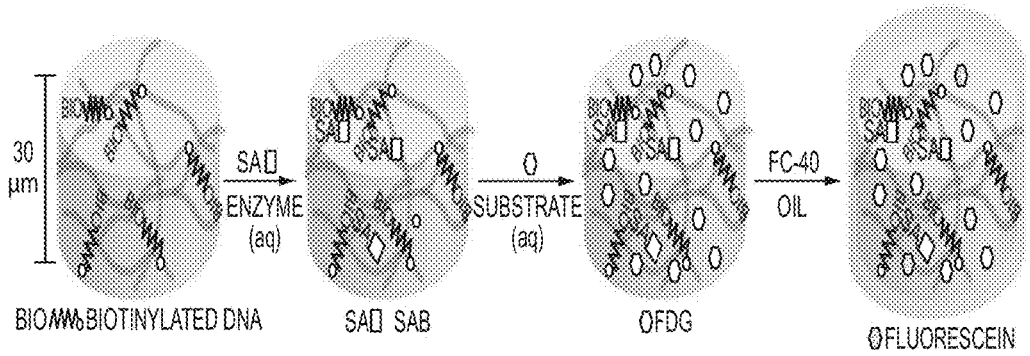
FIG. 3C is a block diagram that illustrates an example microstructure post fixed to a microchannel and configured to amplify detection of covalently embedded DNA in a small reaction volume using an enzyme and substrate, according to an embodiment.

An example enzymatic amplification assay was then designed using the aforementioned biotinylated gel posts and streptavidin-conjugated enzymes. This workflow is shown in FIG. 3C. FIG. 3C is a block diagram that illustrates an example microstructure post fixed to a microchannel and configured to amplify detection of covalently embedded DNA in a small reaction volume using an enzyme and substrate, according to an embodiment. FIG. 3C depicts the reaction that occurs on a single post inside the channel. The enzyme incubations was carried out using the same flow conditions that had been previously optimized using SA-PE. The streptavidin-conjugated enzyme SAB was first flowed through the device for 1 hour at a flow rate of 10 μL/minute in step 207 followed by a PBST rinse step 209 to remove any unbound enzyme. The device was then loaded with the small molecule enzymatic substrate solution in step 211, which rapidly diffused into the hydrogel posts. Once turned over by the enzyme, this small molecule substrate became fluorescent and thus became the observable product.

Figure 10:
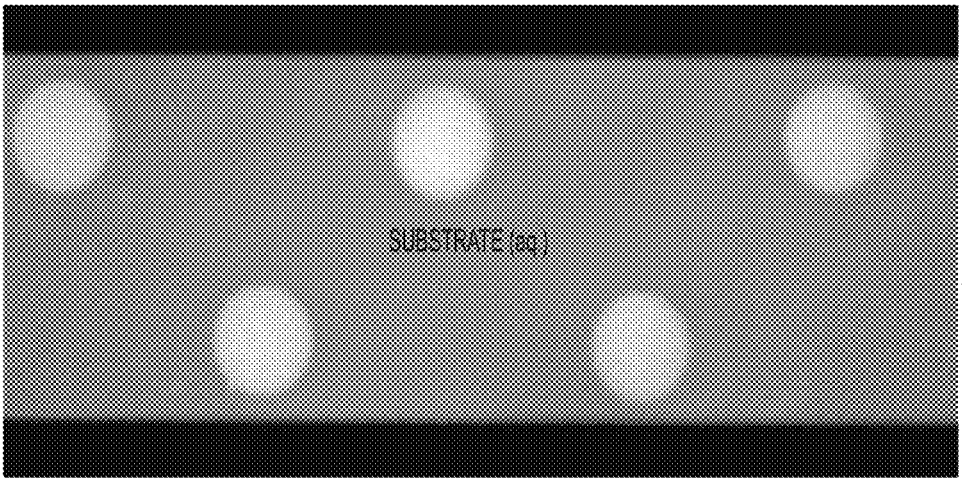
FIG. 10 is an image that illustrates example effect of flushing a microstructure post with a substrate solution in a microchannel, according to an embodiment.

It is important to note that the addition of the substrate in step 211 is fundamentally different than prior steps of the assay. While these prior steps render biomolecules such as the streptavidin-conjugated enzyme physically bound to the biotinylated gel matrix, it is not possible to physically entrap the rapidly-diffusing enzymatic substrate molecules in the mesoporous gel frame due to their smaller size. While the gel pore size is on the order of hundreds of nanometers, the small molecules have radii on the order of angstroms. However, when the aqueous phase is displaced using FC-40 in step 213, the oil wraps around the gel post, enabling physical retention of any substrate molecules present in the volume, as had been previously observed with the aqueous food dyes (FIG. 1C). It was also noticed that there might be some chemical tendency of the hydrophobic small molecule substrate to partition into the gel matrix, providing a locally higher concentration of the substrate in the gel posts relative to the surrounding channel immediately prior to the oil flush. FIG. 10 is an image that illustrates example effect of flushing a microstructure post with a substrate solution in a microchannel, according to an embodiment. The substrate appears in higher concentration inside the posts without benefit of any binding. It remains unclear how much this impacts the assay. In some embodiments, the gel chemistry is altered to leverage these partitioning effects. For example, one can easily alter chemistry of the hydrogel by adding constituents, which would allow possible tuning the small molecule chemical partitioning effects, ultimately providing more control on how the hydrogel gets loaded by the small molecule.

Figure 3D:
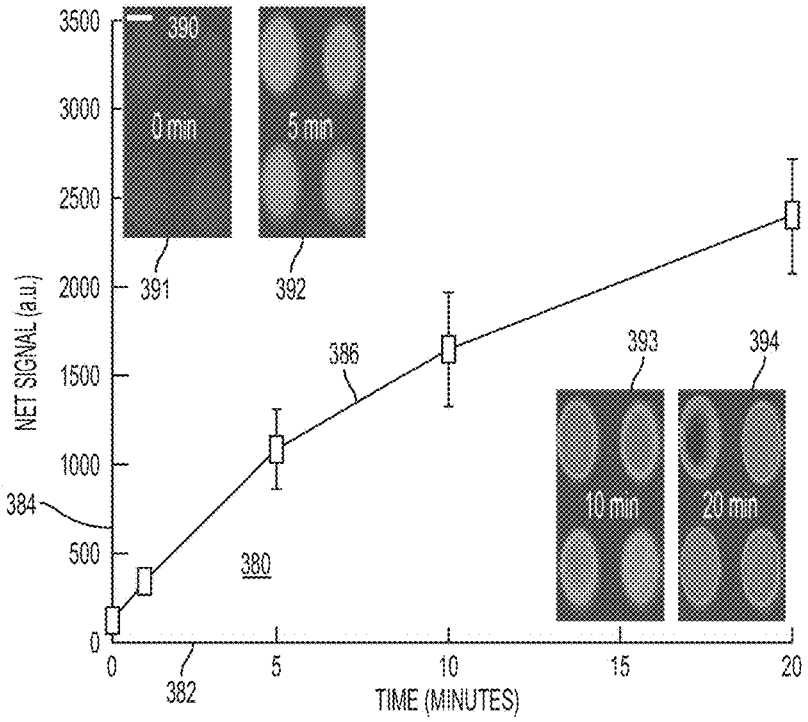
FIG. 3D is graph with inserts showing a series of images that illustrate example increased signal with time of four microstructure posts in a microchannel configured as in FIG. 3C, according to an embodiment.

Once the gel volume is isolated by oil flow in step 213, the enzymatic reaction continues in the confined compartment, leading to amplification of signal as the reaction product concentration increases with time and the availability of substrate. FIG. 3D is graph 380 with inserts 391, 392, 393, 394 showing a series of images that illustrate example increased signal with time of four microstructure posts in a microchannel configured as in FIG. 3C, according to an embodiment. The horizontal axis 382 is time in minutes; and the vertical axis 384 is signal strength in arbitrary units. The trace 386 shows that the signal strength increases with time. The scale bar 390 in the first inset image 391 for 0 minutes represents 50 microns. The other inset images 392, 293, 394 represent the signal at 5, 10 and 20 minutes, respectively.

A design challenge in the described workflow is to ensure that the enzymatic reaction does not proceed significantly in the time that it takes to replace the aqueous substrate-containing phase with the fluorinated oil phase. Otherwise, prematurely turned-over reaction products may be lost to convection and/or may diffuse into other posts, introducing post-to-post cross-talk. Preventing these problems required careful choice of an enzyme/substrate pair. When considering potential enzymes for the example embodiment, horseradish peroxidase (HRP) was ruled out due to its need for multiple substrates which would complicate the proposed workflow. Additionally one of these substrates, $H_2O_2$, is unstable once diluted. Other researchers that have investigated HRP for use in femtoliter sized wells have found that the turnover rate decreases by up to 10-fold in confined settings and that the enzyme can be allosterically inhibited by its product. In some embodiments, however, HRP is used. Similar to other confined reaction platforms, streptavidin-B-galactosidase (SAB, Life Technologies) was chosen, an enzyme compatible with several different small molecule substrates that follow standard Michaelis-Menten kinetics even in confined situations.

Resorufin-B-galactopyranoside (RGB, Life Technologies) and fluorescein-di-B-galactopyranoside (FDG, Life Technologies) were both considered as potential substrates. Although RGB is known to have a faster turnover rate than FDG, proceeds via single-step catalysis, and has been successfully used in the digital enzyme-linked immunosorbent assay ("ELISA") assay, it was found that the starting material had high fluorescence background and that the reaction started significantly before the oil encapsulation step at high enzyme concentration in an example embodiment. It is anticipated that the difference is due to effective enzyme concentration at the start of the reaction in the two different platforms. In the digital ELISA assay, beads are typically labeled with no more than 1-10 enzyme molecules, likely making the initial turnover rate slower, especially in bulk (100 μL) before microwell confinement. In contrast, even assuming a 50% enzyme capture efficiency rate in the hydrogel over a 1 hour enzyme incubation using time-scales derived in previous work, at high (>50 nM) gel-bound biotin concentrations, $>10^6$ enzyme molecules would be bound over the volume of the gel (100 pL), providing a locally higher enzyme concentration relative to enzyme-labeled beads in a bulk solution (100 μL) and leading to faster initial turnover rates.

Figure 11:
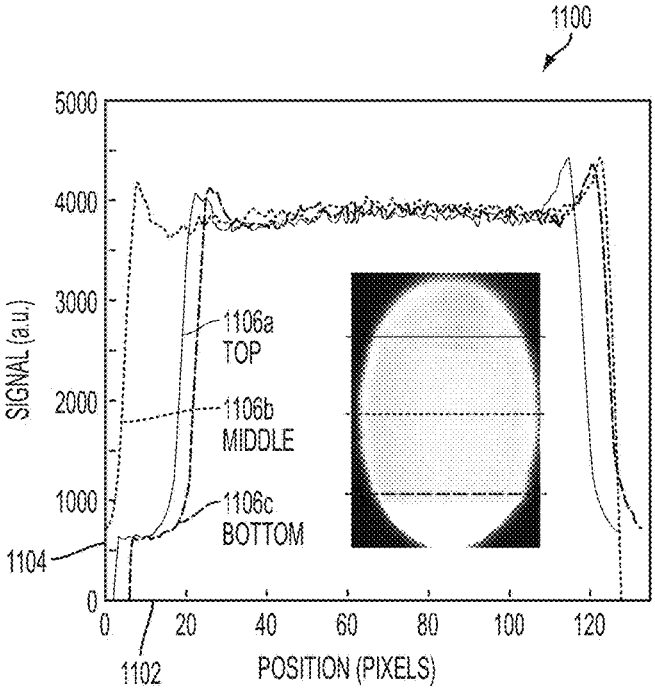
FIG. 11 is a graph that illustrates example uniform fluorescence across a hydrogel microstructure post fixed to a microchannel after amplification using enzyme and substrate, according to an embodiment.

The FDG substrate has also been successfully used in droplet-based digital ELISA approaches, but its catalysis mechanism is different than that of RGB. It is converted through a two-step catalysis in which the first step is rate-limiting, providing the reaction with a natural delay while the intermediate substrate for the second step of the catalysis builds up. This delay could provide sufficient time to isolate the posts before generation of significant reaction product. This hypothesis was tested in a proof-of-concept assay by reacting 50 pg/μL of SAB with gel posts containing high concentration of biotinylated DNA probe (500 nM) for 1 hour and following with FDG (200 μM) and then FC-40. The posts were then time-lapse imaged under fluorescence for 20 minutes as depicted in FIG. 3D, described above. When analyzing the posts, mean signal from the entire circular area of the post was used. Line scans across the diameter of the post show similar fluorescence profiles across the top, middle, and bottom of the posts. FIG. 11 is a graph 1100 that illustrates example uniform fluorescence across a hydrogel microstructure post fixed to a microchannel after amplification using enzyme and substrate, according to an embodiment. The horizontal axis 1102 indicates position on image in pixels; the vertical axis 1104 indicates signal strength in arbitrary units. Traces 1106*a*, 1106*b* and 1106*c* indicated signal profiles across the top, middle and bottom of the post, respectively. All show similar constant signal levels within the post.

The temporal progression of the signal is seen in FIG. 3D, where even one full minute after encapsulation, there is only a 2.6-fold increase in signal from the posts relative to initial background. This suggested that the reaction did not begin to proceed significantly until well after the oil isolation of the posts. In contrast, after 20 minutes, we measured a 17-fold increase in net signal in the posts, and noted that the signal had gradually grown over time.

Based on these initial results, all other reactions were run for the same time course on the reasoning that while this was enough time to generate measurable signal, it would also allow one to maintain a reasonable assay dynamic range. The concentration of SAB was increased 2-fold for all subsequent reactions to increase enzyme kinetics in the final step of the amplification. It is also noted that gel posts in close proximity sometimes led to isolation of multiple posts in one volume or to the formation of water channels between posts. It was therefore determined to arrange the posts in a staggered fashion to provide sufficient (at least 300 μm) lateral distance between posts, such that each post would be separately isolated by the oil phase. Changing the size of the post or the shape of the post or the flow-rate of oil is also employed in some embodiments to ensure robust isolation.

System Characterization

Since previous studies have used PEG hydrogel substrates without confinement for enzymatic assays for glucose sensing, it was determined to quantify the signal enhancement gained by using the final oil-isolation step for these hydrogel microstructures. There are at least two differences between the gels shown here and those used in prior studies. First, gels in other studies are typically more cross-linked due to longer UV-exposure times and different monomer compositions. Second, the prior studies physically entrap the enzyme into the matrix upon polymerization. Since the only species that must diffuse into the gel are small molecules such as glucose and the enzymatic substrate, the pore size of the gel is not as important as in the hydrogel microstructures used here.

The example gel frame is chemically and structurally different in that it is designed to undergo a multistep bioassay requiring both diffusion and reaction of large species. Therefore, it was important to understand the advantage gained by encapsulating the gel using oil in the final step. To this end, two identical devices were each prepared with two kinds of posts in step 201: biotinylated posts containing a final concentration of 50 nM biotinylated DNA and "blank" posts containing no biotin or DNA as a control. The biotinylated posts served as a proxy for posts that had been flushed with a target molecule in step 203. The control provides a means to calculate net background-subtracted signal arising from the biotinylated posts. 100 pg/μL of SAB was flushed through each device for 1 hour in step 207 and excess enzyme rinsed out using PBST in step 209. Both devices were then flushed with FDG in step 211, but only one device was subject to the final FC-40 flush in step 213. After 20 minutes, both devices were imaged in step 215 for fluorescence signal from posts.

Figure 4A:
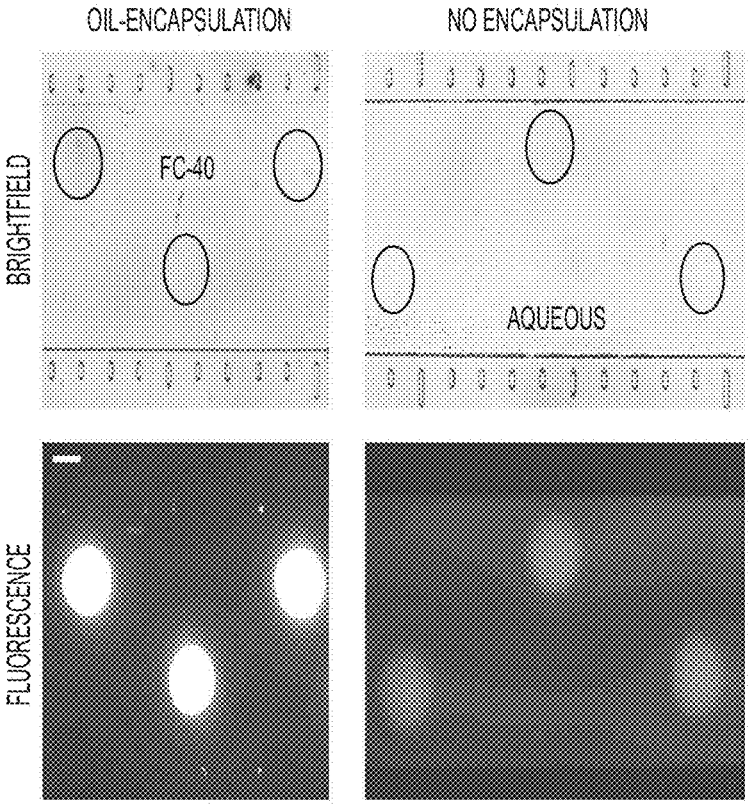
FIG. 4A is a set of images that illustrate example increased fluorescent signal with oil encapsulation compared to no oil encapsulation, according to an embodiment.
Figure 4B:
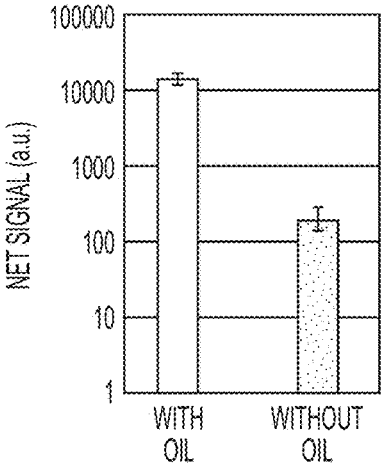
FIG. 4B is a bar graph that illustrates example increased fluorescent signal with oil encapsulation compared to no oil encapsulation, according to an embodiment.
Figure 12:
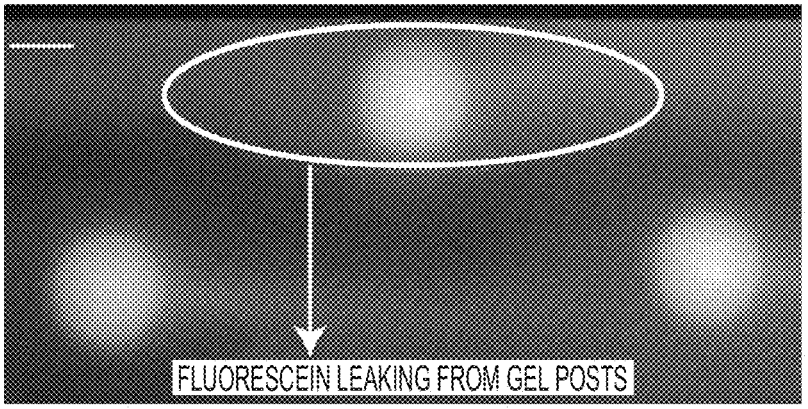
FIG. 12 is an image that illustrates example fluorescent product molecules leaking from a hydrogel microstructure when not encompassed by an oil flow, according to an embodiment.

FIG. 4A is a set of images that illustrate example increased fluorescent signal with oil encapsulation compared to no oil encapsulation, according to an embodiment. The scale bar indicates a distance of 100 microns. FIG. 4B is a bar graph that illustrates example increased fluorescent signal with oil encapsulation compared to no oil encapsulation, according to an embodiment. It is noted that although the hydrogel posts were able to naturally retain some fluorescent product without being oil-encapsulated, there was rapid diffusion of the product into the channel. This is further demonstrated in FIG. 12. FIG. 12 is an image that illustrates example fluorescent product molecules leaking from a hydrogel microstructure when not encompassed by an oil flow, according to an embodiment. Such leakage would certainly contribute to cross-talk in a multiplexed setting and would decrease assay sensitivity. It is further noted that, even though there was measurable background-subtracted signal from these non-confined posts, it was far less than the net signal observed when the posts were oil-encapsulated. FIG. 4B shows at least a 60-fold net signal increase due to the oil-isolation was measured. While the actual enhancement may have been greater, the detector used in the example embodiment was saturated at this high biotin concentration.

Figure 5A:
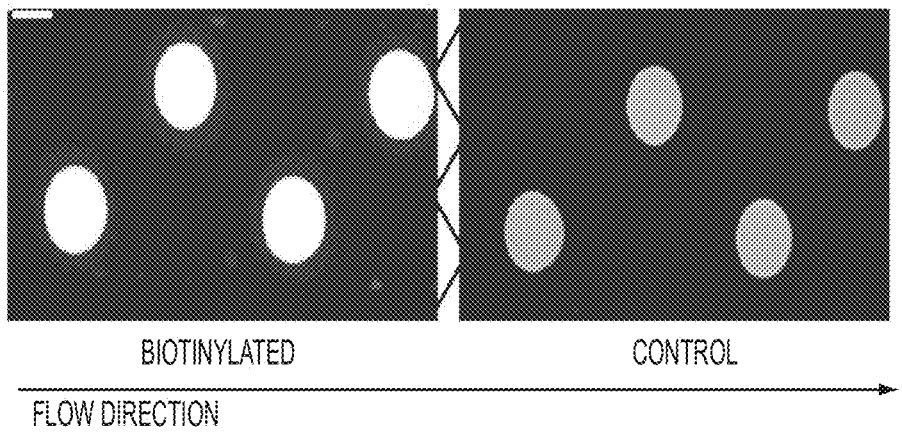
FIG. 5A is an image and FIG. 5B is a bar graph that illustrate example little cross talk between functionalized and non-functionalized hydrogel microstructures, according to an embodiment.
Figure 5B:
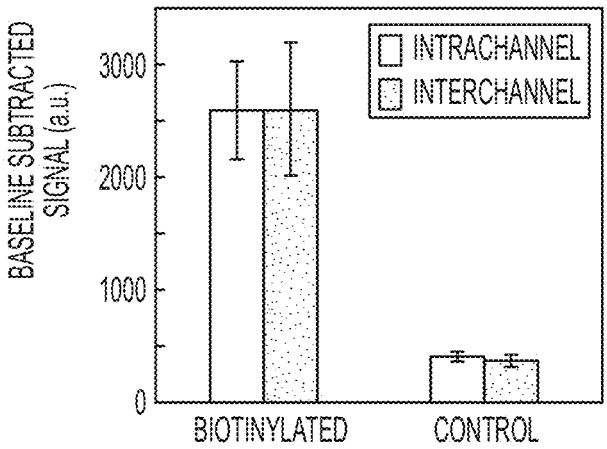

Whether cross-talk among posts occurred in the channel as a result of the substrate and oil flush steps was evaluated by designing an experiment to quantify the effect of high signal-generating biotinylated posts on signal recorded from adjacent control "blank" posts in the same channel. In an "intrachannel" scenario, both biotinylated posts (5 nM) and control posts were immobilized in the same channel. In an "interchannel" scenario, biotinylated posts and control posts were immobilized in separate channels. SAB, FDG, and FC-40 were then flowed through all 3 channels and posts were imaged after 20 minutes. The scenario most likely to generate cross-talk was mimicked: a situation in which high-signal generating posts upstream of the control may prematurely begin to react and generate fluorescent product which is then swept downstream into the control posts before encapsulation. All reagents were accordingly flowed from the side of the channel containing the biotinylated posts towards the side of the channel containing the control posts in the intraplex assay. FIG. 5A is an image and FIG. 5B is a bar graph that illustrate example little cross talk between functionalized and non-functionalized hydrogel microstructures, according to an embodiment. The scale bar in FIG. 5A represents 100 microns Comparison of fluorescence signal from the intraplex assay and interplex assay showed that the baseline subtracted signal was the same for both biotinylated and control posts in both situations, ensuring that the assay workflow did not cause any measurable cross-talk.

Multiplexed Nucleic Acid Assay

Since there was negligible cross-talk between posts, it is possible to run multiplexed assays within the same device. An intrachannel multiplexed nucleic acid detection assay was implemented using a set of three short (20 nucleotide) DNA probe sequences and corresponding complementary biotinylated targets listed in Table 1, above, which would not cross-react with each other based on prior work with nucleic acid capture on hydrogels.

Figure 6A:
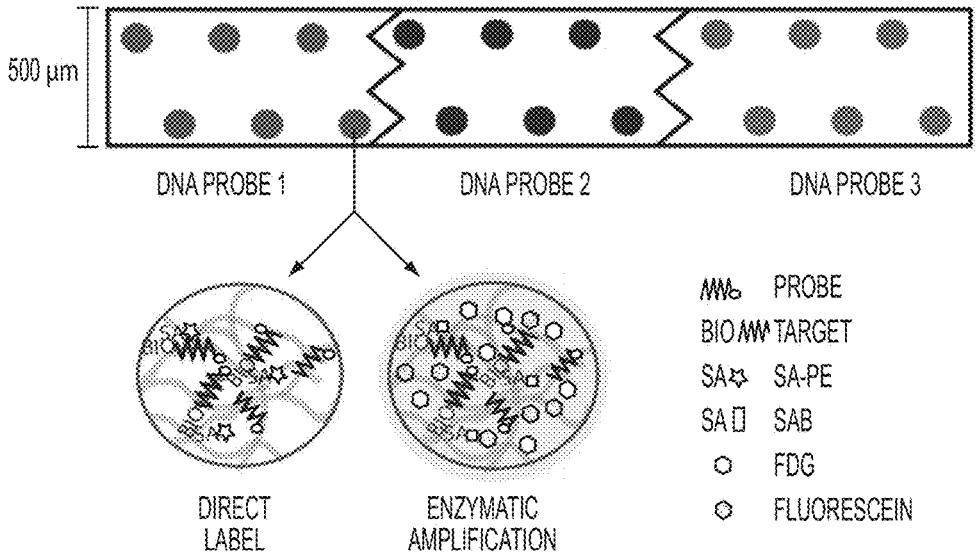
FIG. 6A is a block diagram and FIG. 6B is a bar graph that illustrate example multiplexed target assay using different hydrogel microstructures in the same microchannel, according to an embodiment.
Figure 6B:
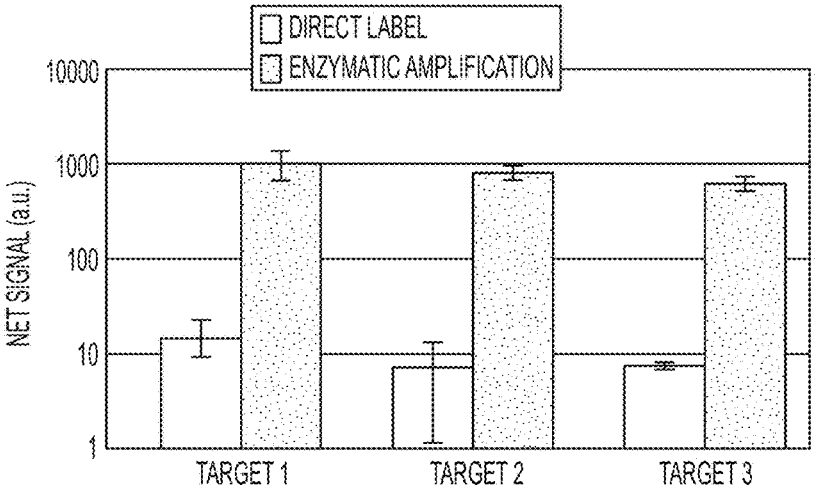

Posts containing 10 μM DNA probe 1, 10 μM DNA probe 2, and 10 μM DNA probe 3 were polymerized adjacent to each other in the same microfluidic channel during step 201. FIG. 6A is a block diagram and FIG. 6B is a bar graph that illustrate example multiplexed target assay using different hydrogel microstructures in the same microchannel, according to an embodiment. The workflow included incubation step 203 in which biotinylated targets hybridize with the gel-embedded probes. In this target flow step 203, channels were initially either incubated with 0 pM of all DNA targets or 10 pM of all DNA targets diluted in 1×PBS (140 mM NaCl) for 1 hour at room temperature. After rinsing with PBST in step 205, posts were either directly labeled using 2 ng/μL of SA-PE in step 211 or 100 pg/μL of enzyme SAB for 1 hour in step 207. The latter channels were finally flushed with FDG in step 211 and both channels flushed with FC-40 in step 213. This allowed a comparison between the boost in signal from the 20 minute amplification step relative to a very robust direct labeling scheme at low concentrations of DNA target. In this case, signal from the 0 pM target channels were considered the "control" and net signal was computed by subtracting any signal arising from posts in these channels. A value 10 pM was chosen as a "low" DNA target concentration based on previous studies that have captured and directly labeled similarly sized nucleic acid sequences on hydrogel substrates. In these prior studies, 10 pM DNA target is either close to the limit of detection or out of the detection range. Accordingly, for all three targets, barely detectable net signal was observed at 10 pM target from the direct labeling scheme using SA-PE. In contrast, there was almost two orders of magnitude increase in net signal using the encapsulated enzymatic amplification for just 20 minutes, as shown in FIG. 6B.

The next goal was to ascertain the sensitivity of this new assay and compare it to what would be achievable through the direct labeling scheme with SA-PE. We prepared posts in a series of channels in order to generate a dose-response curve for both schemes (direct label versus enzymatic amplification). Target concentrations were evaluated across the same range for both schemes. DNA targets were diluted at concentrations ranging from 500 fM to 500 pM in 1×PBS. The same protocol mentioned previously was followed for each target concentration.

Figure 7:
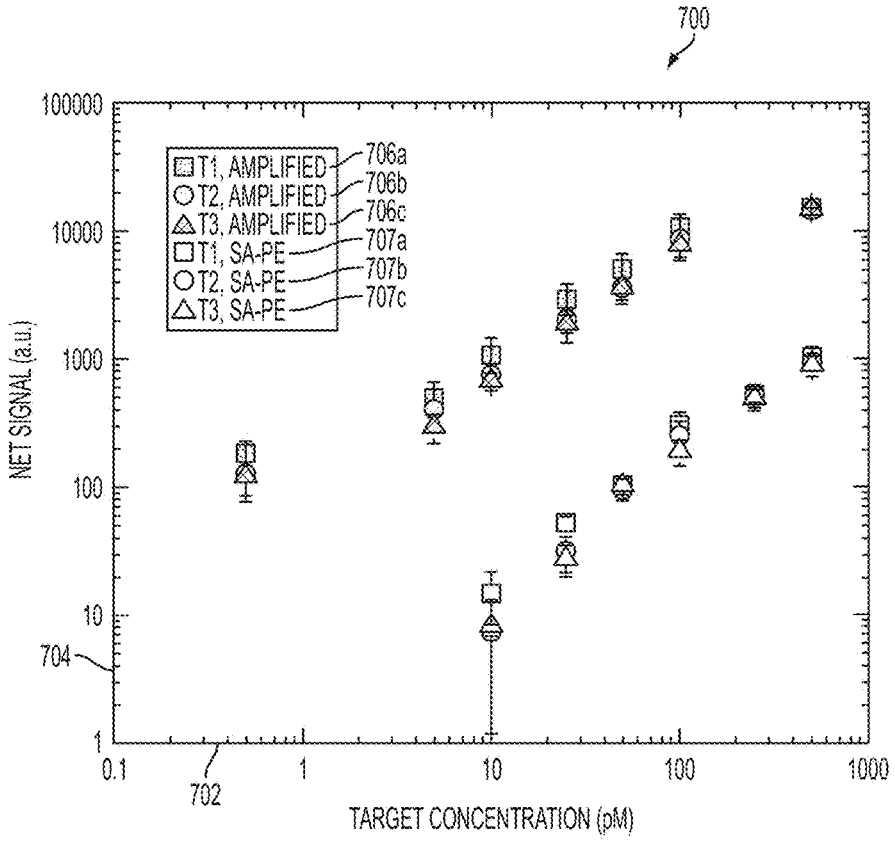
FIG. 7 is a graph that illustrates example calibration curves for three target nucleic acid molecules without and with enzyme-substrate amplification, according to an embodiment.

The calibration curves are shown in FIG. 7, and resulting limits of detection (LOD) are tabulated in Table 2. FIG. 7 is a graph 700 that illustrates example calibration curves for three target nucleic acid molecules without and with enzyme-substrate amplification, according to an embodiment. The horizontal axis 702 indicates target molecule concentration in solution expressed in picoMolar (pM, 1 pM=$10^{-12}$ Molar). The vertical axis 704 indicates net signal above background in arbitrary units. Limit of detection was defined here as the target concentration at which the signal-to-noise ratio is 3. We took the assay noise to be the standard deviation calculated around the 0 pM target incubation. There was 22 to 57-fold improvement in assay sensitivity, depending on the nucleic acid sequence when using the enzymatic amplification. Furthermore, a linear response was noted from 500 fM to 100 pM for the enzymatic amplification and from 25 pM to 500 pM for the direct labeling. In the case of the amplification reaction, the curve hits saturation due to the exposure time of the camera used as detector and not because of intrinsic reaction saturation. By changing the imaging conditions, it is anticipated to gain linearity over a longer range. In other embodiments, changes in post sizes, arraying strategy, or channel dimension are employed to increase the number of targets that can be multiplexed.

TABLE 2

Sensitivity comparison between direct labeling and enzyme amplification

| | LOD SA-PE (pM) | LOD enzymatic amplification (pM) | Fold-increase in sensitivity |
|---|---|---|---|
| DNA Target 1 | 8.2 | 0.37 | 22 |
| DNA Target 2 | 13 | 0.23 | 57 |
| DNA Target 3 | 10 | 0.40 | 25 |

Exchange of Reagents in Aqueous Solutions.

Figure 8:
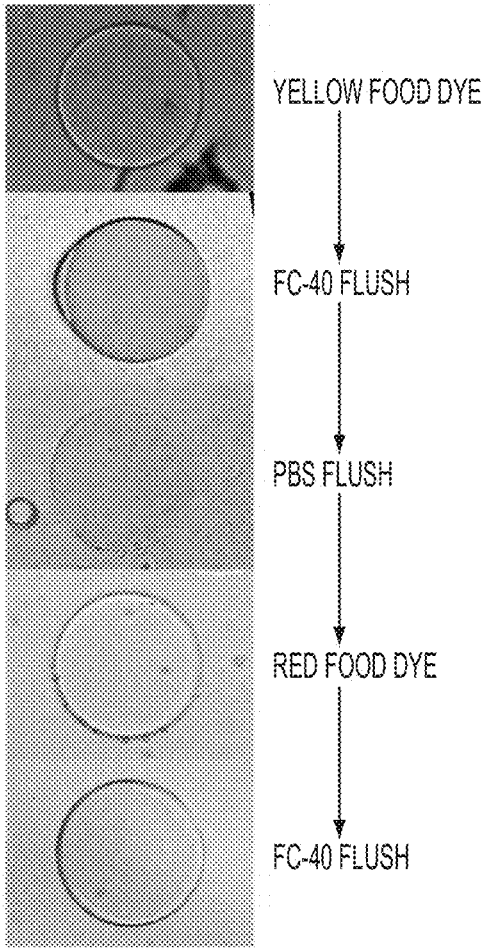
FIG. 8 is a set of images that illustrates example reuse of hydrogel microstructure with different aqueous solutions, according to an embodiment.
Figure 13:
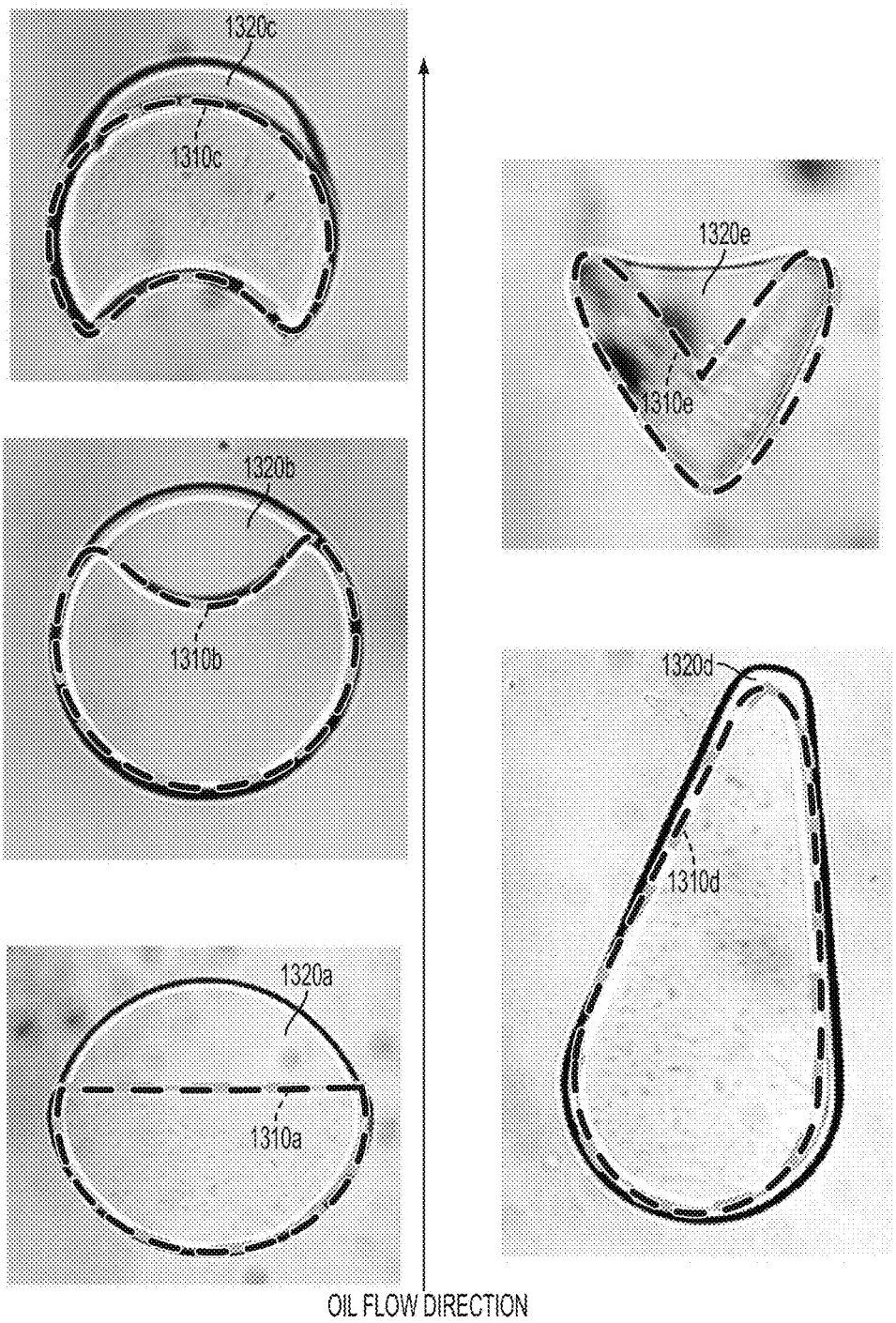
FIG. 13 is a set of images that illustrates example shapes of hydrogel microstructures and corresponding solutions encapsulated by the immiscible fluid, according to an embodiment.

Using a straight microfluidic channel interfaced with a pressure-driven flow allows easy exchange of reagents in and out of the device. FIG. 8 is a set of images that illustrates example reuse of hydrogel microstructure with different aqueous solutions, according to an embodiment. In this example, a channel is initially filled with an aqueous solute (yellow food dye), the yellow solute-loaded gel is then confined within the oil phase with an oil-flush. The channel is rinsed with an aqueous buffer (PBS) to release the contents of the hydrogel microstructure, and the hydrogel microstructure is re-loaded with a new aqueous solute (red food dye). The red solute-loaded gel is then confined within the hydrogel microstructure with an oil-flush FIG. 13 is a set of 5 images that illustrates example shapes of hydrogel microstructures and corresponding solutions encapsulated by the immiscible fluid, according to an embodiment. In each image the oil flow direction is the same but a different, non-cylindrical hydrogel microstructure post is depicted, the post's cross section outlined by a dashed gray line 1310*a*, 1310*b*, 1310*c*, 1310*d* and 1310*e*, respectively. An aqueous solution is encapsulated around the hydrogel microstructure but does not follow the microstructure shape exactly. Instead, the aqueous solution is trapped in a small volume that extends outside and downstream of the microstructure to complete a flow line of the oil flow.

Thus a reservoir of aqueous solution 1320*a*, 1320*b*, 1320*c*, 1320*d* and 1320*e*, respectively, is formed outside each of one or more of the illustrated microstructures.

Figure 14:
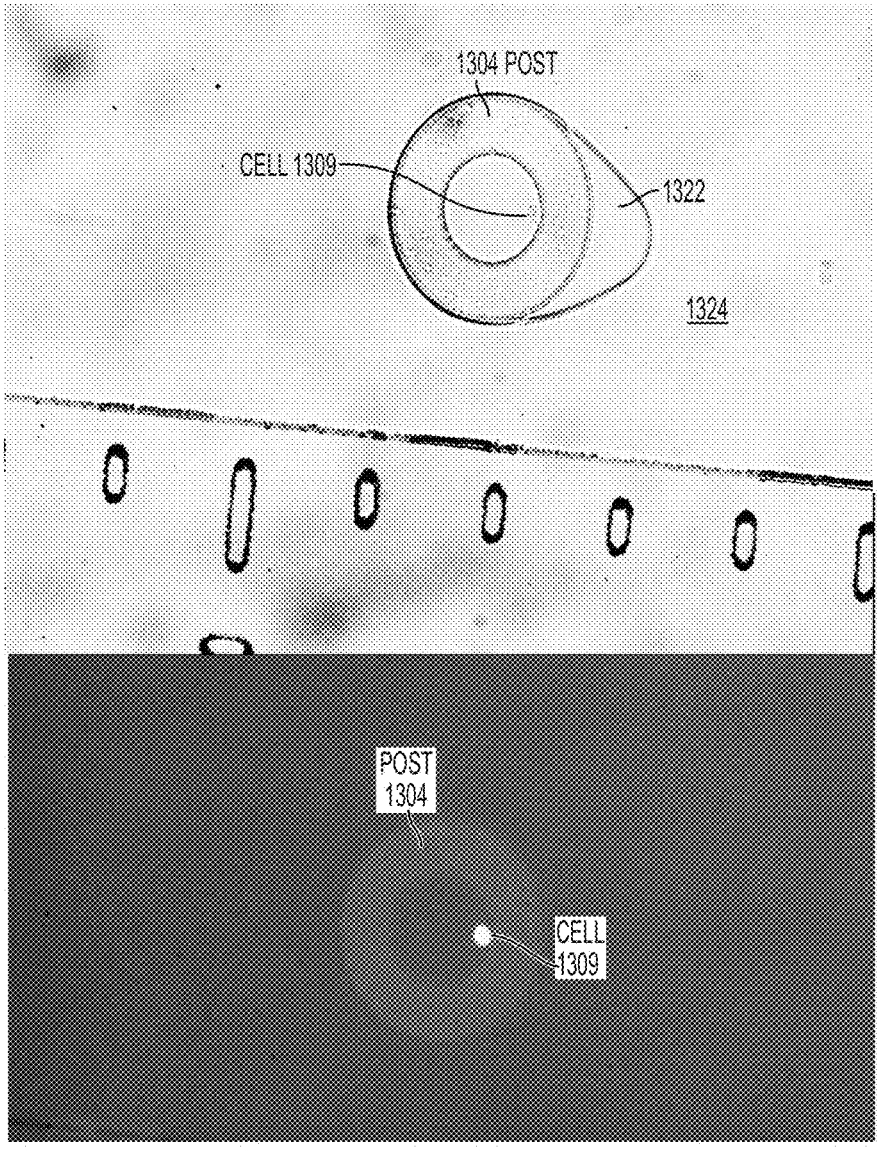
FIG. 14 is a brightfield and fluorescent pair of images that illustrates example capture of a cell by hydrogel microparticle post formation and immiscible fluid encapsulation, according to an embodiment.

FIG. 14 is a brightfield (top) and fluorescent (bottom) pair of images that illustrates example capture of a cell 1309 by hydrogel microparticle post 1304 formation and immiscible fluid 1324 encapsulation, according to an embodiment. This cell 1309 expresses green fluorescent protein (GFP) and remains bright in the fluorescent image (bottom) even after isolation. This is an example of photo-polymerizing a hydrogel microstructure around other biological entities such as cells, which allows single-cell secretion experiments within a confined volume in some embodiments, or allows cell lysis in an initial aqueous solution flush with lysing agent to release and then capture contents of the cell within the confined volume in the same or other embodiments. Thus providing the hydrogel microstructure further comprises forming the hydrogel microstructure in place around a biological cell by exposing a mixture of a monomer and the plurality of molecules of the probe species and a photo initiator to shaped illumination. Furthermore, contacting the hydrogel microstructure with a first solution further comprises contacting the hydrogel microstructure with a lysing agent to disrupt a cell wall of the biological cell to release, from the biological cell, a sample including the first solution.

In some embodiments, after formation of a hydrogel microstructure, a cell is trapped on the hydrogel microstructure using hydrodynamic forces and microstructure shape (e.g., a v shaped microstructure with the open part of the v facing upstream) or using cell-surface markers (e.g., molecules in the hydrogel frame that bind to cell membrane receptors) under flow conditions.

In various embodiments the microstructure is polymerized around a cell, as described above, or is polymerized such that the cell is embedded in the hydroge, or includes a covalently embedded probe against some cell surface marker, thus causing the cell to adhere to the microstructure. In the latter embodiment, a cell solution is flushed past the posts—and a cell with the marker would adhere to the post because it would be expressing the target molecule on its surface. A common example in literature is to use an antibody against a marker called EpCAM which is overexpressed in cancer cells. This is in addition to embedding a probe, if any, for a target molecule. The target molecule would then be detected if secreted by the cell, or if the target molecule is included inside the cell and the cell membrane is broken with a lysing agent.

Figure 15A:
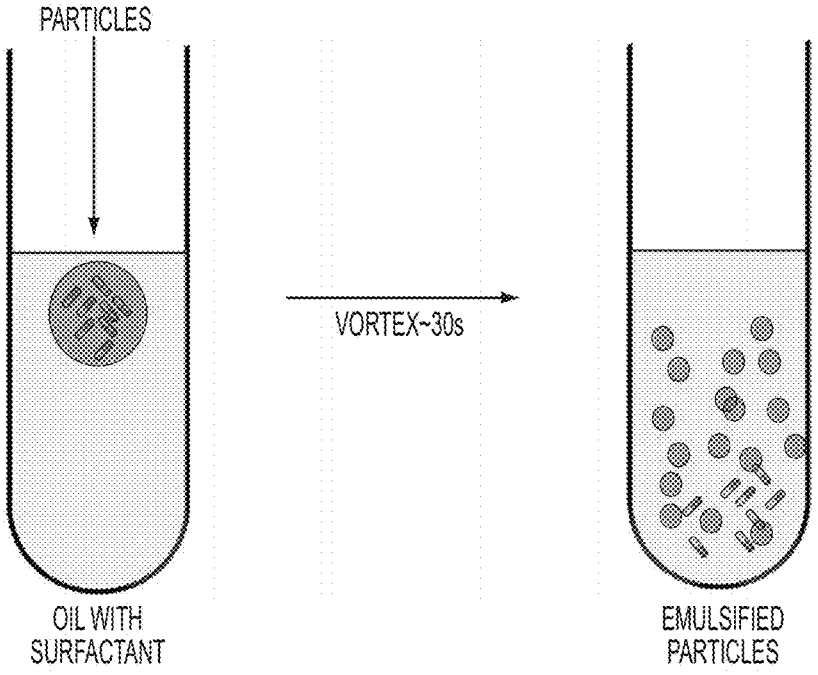
FIG. 15A is a block diagram that illustrates example method for encompassing in oil microstructure particles loaded with an aqueous solution, according to an embodiment.
Figure 15B:
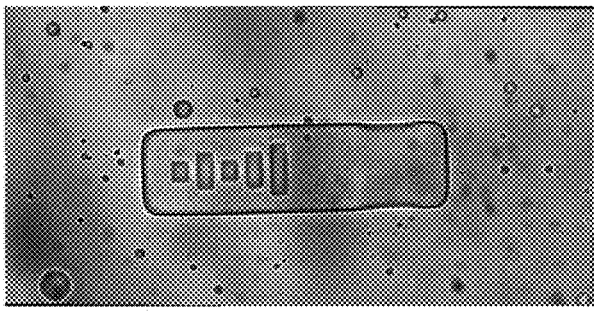
FIG. 15B is an image that illustrates an example microstructure particle loaded with an aqueous solution encompassed in oil, according to an embodiment.

In some embodiments, a hydrogel particle is used and after exposure to the last aqueous solution in step 211, the particles in the aqueous solution are introduced into the immiscible fluid, such as an oil, and confined into a water droplet within an oil phase (with a surfactant to confer stability to the emulsion). With sufficient energy applied, the aqueous solution droplets become smaller and smaller until they just encapsulate the hydrogel particle, thus encapsulating the microstructure in the immiscible fluid during step 213. FIG. 15A is a block diagram that illustrates example method for encompassing in oil microstructure particles loaded with an aqueous solution, according to an embodiment. Particles in aqueous solution are dropped into a container of oil with surfactant, and subjected to high kinetic energy, e.g., in a vortex or centrifuge or shaker, such as subjecting to a vortex for about 30 seconds. The particles and aqueous solution droplets without particles are emulsified in the oil. FIG. 15B is an image that illustrates an example microstructure particle loaded with an aqueous solution encompassed in oil, according to an embodiment. In some embodiments, the emulsified particles can then be loaded inside a microfluidic device to be arrayed or for flow-through cytometric analysis in the immiscible carrier fluid.

Figure 15C:
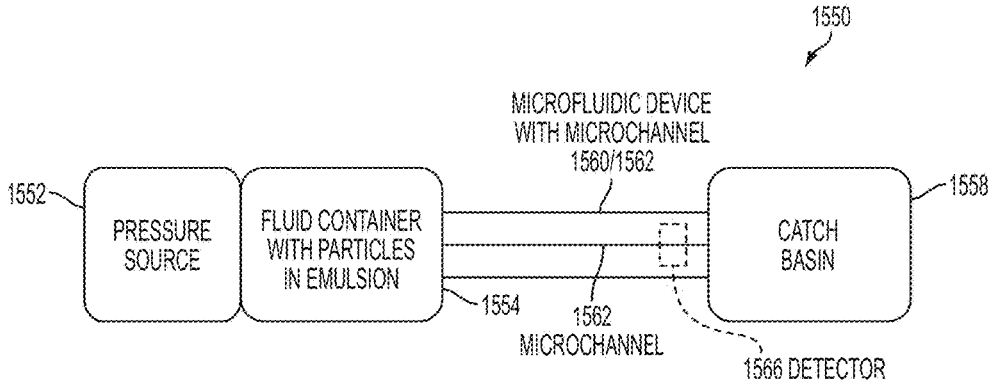
FIG. 15C is a block diagram that illustrates an example apparatus for using microstructure particles loaded with an aqueous solution encompassed in oil, according to an embodiment.

FIG. 15C is a block diagram that illustrates an example apparatus for using microstructure particles loaded with an aqueous solution encompassed in oil, according to an embodiment. The apparatus 1550 includes a microfluidic device 1560 having one or more microchannels 1562. The product of reactions in the microstructures, such as one or more colorimetric or fluorescent products, is observed by detector 1566, such as a photodetector or photodetector array, e.g. a charge coupled device (CCD) array. If the device 1560 is not transparent to the observations, then the device 1560 includes an observation port (not shown) between the detector 1566 and the microchannel 1562. Emulsified fluid including microparticles is introduced into the microchannel 162 from one fluid container 1554 (e.g., pipette) by pressure supplied by a pressure source 1552. Fluid passes out of container 1554 into the microchannel 162 through a port (e.g., pipette needle) in the fluid container 1554. The fluid that passes through the microchannel is ejected into a catch basin 1558. The fluid container 1554 is disposed between the pressure source 1552 and the microfluidic device 1560 and the fluid inside is moved by the pressure source 1552. The combination of fluid container 154 and pressure source 152 composes a fluid source. In some embodiments, the fluid source includes a source of kinetic energy to emulsify the aqueous solution and particles filled with the aqueous solution.

Thus, in some embodiments, the hydrogel microstructure is a microparticle not affixed to the device and the source of immiscible fluid comprises a vortex that emulsifies an aqueous solution around the microparticle in the immiscible fluid.

Figure 16A:
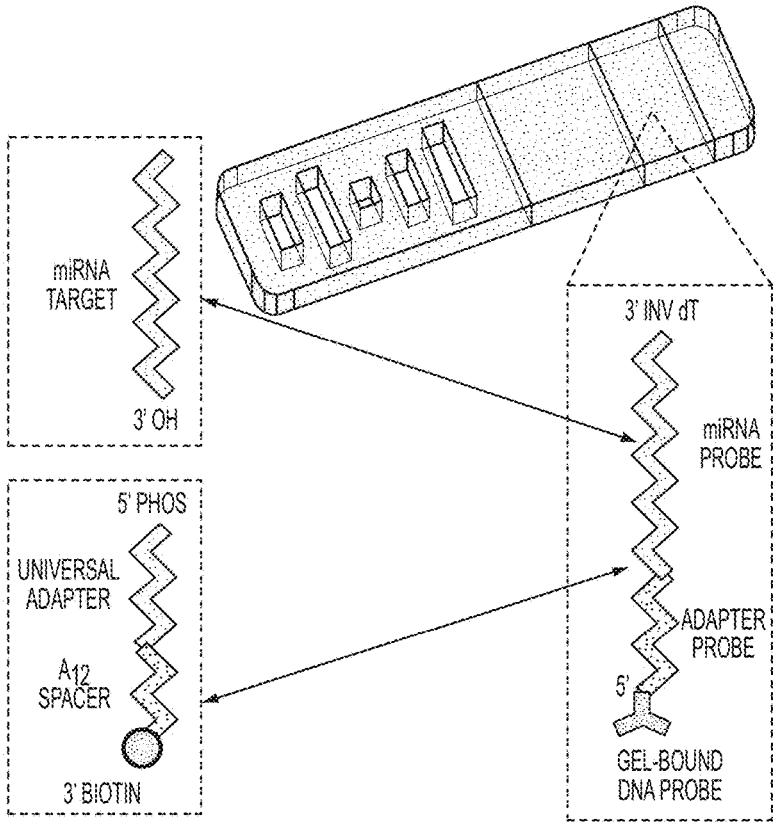
FIG. 16A is a block diagram that illustrates example method for adding a miRNA probe to a hydrogel microparticle, according to an embodiment.

A microRNA (miRNA) is a short nucleic acid biomarker present at low concentrations (100-500 attoMolar, aM, 1 aM=$10^{-18}$ Molar) in serum and at low copy numbers in cells (<500). A ligation-based labeling scheme is used in which gel-bound miRNA is labeled using biotinylated universal linker. FIG. 16A is a block diagram that illustrates example method for adding a miRNA probe to a hydrogel microparticle, according to an embodiment. The miRNA probes are made of DNA, purchased as acrylate-modified DNA sequences. This sequence contains both the target binding region and the Universal linker A12 binding region (called adapter probe). This is part of the microstructure polymerization step 201.

In step 203 the miRNA target is prepared. To keep the target bound through the later rinse steps, step 203 also includes binding the miRNA target to the biotinylated universal linker (also called the universal adapter). A ligase is also added to the target solution to paste together the miRNA target and the linker together. This complex will ONLY be stable if these two sequences are glued together. If only the linker (adapter) is contacted to the probe, then the target can fall off during the rinse step 205. After the streptavidin-enzyme complex is introduced to the particles in aqueous solution during step 207, and substrate in step 211, the particles are isolated in an oil emulsion in step 213; and enzymatic amplification is run to gain high sensitivity.

Figure 16B:
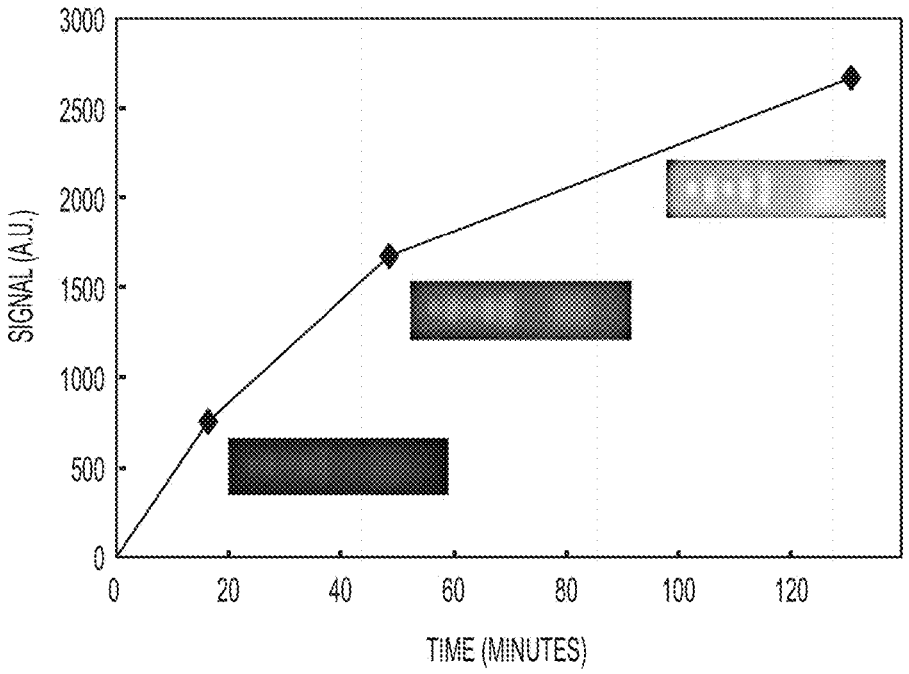
FIG. 16B is a graph that illustrates example miRNA signal amplification using enzyme and substrate labeling in an oil emulsion, according to an embodiment.

FIG. 16B is a graph that illustrates example miRNA signal amplification using enzyme and substrate labeling in an oil emulsion, according to an embodiment. Net signal at time (120 minutes) of imaging during step 215 is 72× signal observed using a direct labeling scheme (SA-PE). In various embodiments, the time of imaging varies from about one hour to about 4 hours.

Calculation of Channel Péclet Number (Pe)

Pe is defined as the rate of diffusive time ($\tau_d$) to convective time ($\tau_c$). We define $$\tau_d = \frac{l^2}{D}$$

where l is characteristic length and D is the diffusion constant of the analyte in the channel, and $$\tau_c = \frac{l}{u}$$

where l is characteristic length and u is mean channel velocity. If we take the ratio, we get the expression below for Pe.

$$Pe = \frac{\tau_d}{\tau_c} = \frac{ul}{D}$$

We take l=500 μm (channel width), D=100 $\mu m^2/s$, and calculate u using the volumetric flow rate of the channel, which is 10 μL/minute through a cross sectional area of 30 μm×500 μm, giving ~$10^4$ μm/s. The resulting Pe=$5\times10^4$ Comparison of Channel Hydrodynamic Resistance to Gel Post Resistance To calculate the hydrodynamic resistance of our hydrogel, consider the gel matrix as a porous media that obeys Darcy's Law $$\Delta P_{gel} = \frac{\mu L}{kA_{gel}} Q$$

where k is the Darcy permeability with dimensions of $(\text{length})^2$, A is the cross-sectional area of the gel, and L is the length of the gel. It is assumed that the Darcy permeability will scale as the square average pore size of the gel $$k \sim r_{pore}^2.$$

This is a reasonable first estimate for k, which should depend on the dimension that provides the most resistance to flow. In this case, a natural length scale is the pore size of the gel, an assumption that is corroborated by previous experimental work examining Darcy permeabilities in hydrogels.

Then define a hydrodynamic gel resistance such that $$\Delta P_{gel} = R_{gel} Q$$

where from Darcy's Law, $$R_{gel} = \frac{\mu L}{r_{pore}^2 A_{gel}}$$

and $$A_{gel} = h_{channel} d_{gel}.$$

To calculate the surrounding channel resistance, we assume that $$\Delta P_{channel} = \frac{\mu L}{w_{channel} h_{channel}^3} Q$$

The relation above holds true for a unidirectional and laminar flow where height (h)<<width (w).[4] In this case, $$\Delta P_{channel} = R_{channel} Q$$

where $$R_{channel} = \frac{\mu L}{w_{channel} h_{channel}^3}$$

Then examine the denominator, and find that the expression can be rewriten in terms of a channel cross-sectional area as shown below.

$$R_{channel} = \frac{\mu L}{A_{channel} h_{channel}^2}$$

where $$A_{channel} = h_{channel} w_{channel}.$$

The ratio of the gel resistance to the channel resistance over the same length scale, shows they are related through the expression shown below $$\frac{R_{gel}}{R_{channel}} = \frac{h_{channel}^2 A_{channel}}{r_{pore}^2 A_{gel}}.$$

In the vicinity of the gel post, $A_{channel} \sim A_{gel}$ when the post sits in the middle of the channel, the final expression relating the two resistances is $$\frac{R_{gel}}{R_{channel}} = \frac{h_{channel}^2}{r_{pore}^2}.$$

Calculate this ratio using $h_{channel}$=30 μm and $r_{pore}$=0.1 μm, and find that $$\frac{R_{gel}}{R_{channel}} = 90000.$$

This result suggests that the gel resistance is so much higher than the surrounding channel resistance that there would not be any significant convection through the pores of the gel.

Multiplexed Micro-RNA Assay

In yet another experimental embodiment, a multiplexed micro-RNA assay apparatus and method are as described here. This embodiment includes an entirely on-chip miRNA assay which takes advantage the hydrogel-specific detection advantages described above and adopts the above labeling scheme while leveraging the precise fluidic control inside a microfluidic channel. This embodiment further optimizes and adapt the small volume amplification scheme to achieve high sensitivity and minimize total RNA input for multiplexed measurements.

MicroRNAs (miRNAs) are short noncoding RNAs that have recently emerged as promising diagnostic markers for several diseases due to their high stability and unique dysregulation patterns. However, clinical translation of miRNA diagnostics still faces several practical challenges. These include sequence homology, diversity of abundance, and the exacting demands of a clinical assay, which requires multiplexed, sensitive, and specific analysis of miRNAs from low sample inputs while minimizing assay time, external equipment and number of cumbersome steps. Although commercial platforms provide large-plexes and high sensitivity, they fall short on the other metrics. Microarray assays require overnight hybridization, several steps, and complicated equipment for fluid control. Meanwhile, qPCR-based methods are at risk of sequence bias arising from target-based amplification and can require large (>500 ng) amount of input RNA. Commercial microfluidic versions of qPCR reduce assay volume and allow greater parallelization, but still require cDNA synthesis prior to chip-loading, and utilize target amplification. Furthermore, studies that have compared commercial profiling methods have found inter-platform discrepancies in miRNA quantification. Recently developed microfluidic on-chip assays have been able to decrease assay time but do not meet all other clinical needs. A recent study used isotachophoresis for rapid and specific let-7a detection from total RNA samples, but the system could not multiplex, offered only moderate detection sensitivity (10 pM), and required extensive optimization for specificity. Besides, fluidic limitations demanded a much larger quantity of total RNA (1 μg) than was actually processed through the device (5 ng). Another recent study demonstrated a power-free PDMS chip for miRNA quantification in resource-limited settings with better sensitivity (500 fM) over short (20 min) times, but did not make multiplexed measurements from patient samples.

In these experimental embodiments, all assays were performed in commercial straight glass channels (Hilgenberg GmbH) with 1 mm width, 18 mm length, and 0.05 mm height. For flow delivery, PDMS (Corning, Sylgard 184) connection ports were punched using 15-gauge Luer stub, and were bonded to inlets and outlets of glass chips using an oxygen plasma treatment system (Harrick Scientific, 25 sec on RF=high) and a subsequent incubation at 80° C. for 20 min. To promote adhesion of the gel pads on glass a monolayer of 3-(trimethoxysilyl)propyl acrylate (Sigma) was deposited inside the channels. Clean glass channels were filled with 1M NaOH for 1 hr, rinsed with DI water (house supply), and then dried with argon gas. They were then filled with a 2% (v/v) solution of 3-(trimethoxysilyl) propyl acrylate mixed in 24.5% (v/v) 1×PBS (phosphate buffered saline, Corning), and 73.5% (v/v) ethanol for 30 min. The modified channels were then washed with ethanol, dried with argon gas, and stored at 80° C. until the time of usage. After bioassays, chips were simply cleaned by soaking in 1M NaOH overnight. They could then be used for several more rounds (at least 10 times) after repeating the activation process.

Multiplexing was achieved through a spatial encoding scheme. The probe DNA had two regions: a miRNA target-binding (probe) domain and a universal linker (adapter probe) domain used for labeling as shown in FIG. 16A but for free floating microparticles. In the current experimental embodiment, the microstructures are posts fixed to the glass slide. After 90 min miRNA hybridization, the biotinylated universal linker (adapter probe) was ligated to the probe-target complex (10 min), and the complex was finally labeled using a streptavidin-conjugated fluorophore (SA-PE, 30 min) or using a streptavidin-conjugated enzyme (SAB, 15 min), e.g., in step 207. In the latter case, there was an additional amplification step 213 (15 min) that occurred in the confined environment of the hydrogel. All assay steps used a steady, high Péclet number, gravity-driven flow, eliminating the use of expensive flow controllers while maintaining constant reagent delivery in the channel. Steps requiring heating or cooling were performed on a hot plate, enabling stable and continuous sample delivery without need for sample pre-heating.

To ensure robust sequence discrimination, the assay was optimized using let-7a as a model miRNA target. The family members of let-7a are listed in Table 3.

TABLE 3

Members of let-7a miRNA family and all other miRNA probes.

| SEQ ID NO | Oligo Name | Type | Sequence |
|---|---|---|---|
| 8 | let-7a probe | DNA | 5Acryd/GAT ATA TTT TAA ACT ATA CAA CCT ACT ACC TCA/3InvdT |
| 9 | let-7a target | RNA | 5'-UGA GGU AGU AGG UUG UAU AGU U-3' |
| 10 | let-7b target | RNA | 5'-UGA GGU AGU AGG UUG UGU GGU U-3' |
| 11 | let-7c target | RNA | 5'-UGA GGU AGU AGG UUG UAU GGU U-3' |
| 12 | let-7d target | RNA | 5'-CGA GGU AGU AGG UUG CAU AGU U-3' |
| 13 | miR-21 probe | DNA | 5Acryd/GAT ATA TTT TAT CAA CAT CAG TCT GAT AAG CTA/3InvdT |
| 14 | miR-21 target | RNA | 5'-UAG CUU AUC AGA CUG AUG UUG A-3' |
| 15 | miR-145 probe | DNA | 5Acryd/GAT ATA TTT TAA GGG ATT CCT GGG AAA ACT GGA C/3InvdT |
| 16 | miR-145 target | RNA | 5'-GUC CAG UUU UCC CAG GAA UCC CU-3' |

TABLE 3-continued

Members of let-7a miRNA family and all other miRNA probes.

| SEQ ID NO | Oligo Name | Type | Sequence |
|---|---|---|---|
| 17 | miSpike probe | DNA | 5Acryd/GAT ATA TTT TAA GAC CGC TCC GCC ATC CTG AG/3InvdT |
| 18 | miSpike target | RNA | 5'-CUC AGG AUG GCG GAG CGG UCU-3' |
| 19 | universal linker | DNA | /5Phos/TAA AAT ATA TAA AAA AAA AAA A/3Bio/ |
| 20 | Biotinylated probe | DNA | 5'/Acryd/ATA GCA GAT CAG CAG CCA GA/Bio/3' |

While let-7a is commonly dysregulated in several cancers, its homology to other let-7 family members often poses a challenge. For some platforms, specific detection (<15% cross reactivity) requires complicated and customized probe designs for each miRNA target.

Figure 17A:
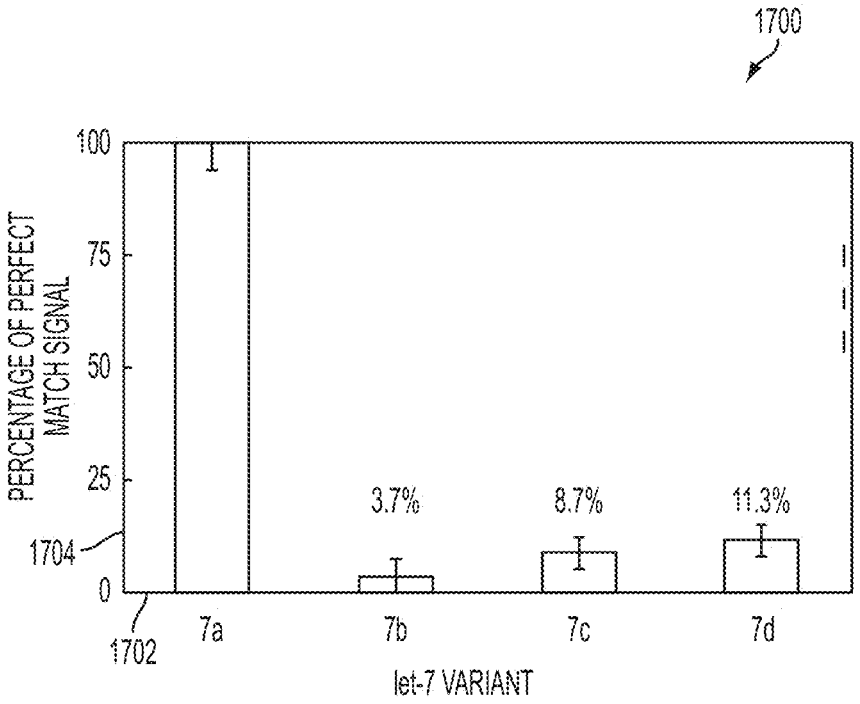
FIG. 17A is a bar graph that illustrates example specificity of the assay for micro-RNA let-7a, according to an embodiment.

Instead, in the chemically-favorable hydrogel environment, comparably high specificities (maximum cross reactivity of 11.3%) were achieved by simply tuning the salt concentration of the hybridization buffer (250 mM NaCl), probe concentration (5 μM inside gel) and using a high (55° C.) assay temperature, which was chosen based on sequence melting temperatures. FIG. 17A is a bar graph 1700 that illustrates example specificity of the assay for micro-RNA let-7a, according to an embodiment. The horizontal axis 1702 indicates let-7 variant and the vertical axis indicates percent of perfect match signal in percent. Only a small percentage of the signals observed for let-7a is observed when exposed to let-7b, or let-7c or let-7d.

Using SA-PE, these assay conditions provided specific and measurable signal at 10 pM target. For best performance in the stringent incubation conditions, the oil encapsulated amplification scheme described above was used. In the scheme, after gel-bound complexes were labeled with SAB, the channel was flushed with enzymatic substrate (FDG) and subsequently with fluorinated oil (FC-40). The latter step confined the gel posts within the oil phase and trapped FDG due to high hydrodynamic resistance inside the gel post relative to the surrounding channel (e.g., as depicted in FIG. 1B). Enzymatically turned over fluorescent reaction products were then dramatically concentrated in the now confined compartments, leading to large signal boosts in short (15 min) amplification times.

A hydrogel geometry was designed to ensure optimal oil encapsulation, structural stability under flow, and minimization of diffusional limitations. The latter two parameters were determined based on experimental observation and provided a minimum (100 μm) and maximum (300 μm) width dimensions for the fixed hydrogel posts respectively. Initial experiments indicated that a cylindrical geometry sometimes led to uneven entrainment of water around the posts during the oil flush, affecting reagent concentrations from post to post (e.g., see entrained aqueous solution 1322 around post 1304 in FIG. 14).

Figure 17B:
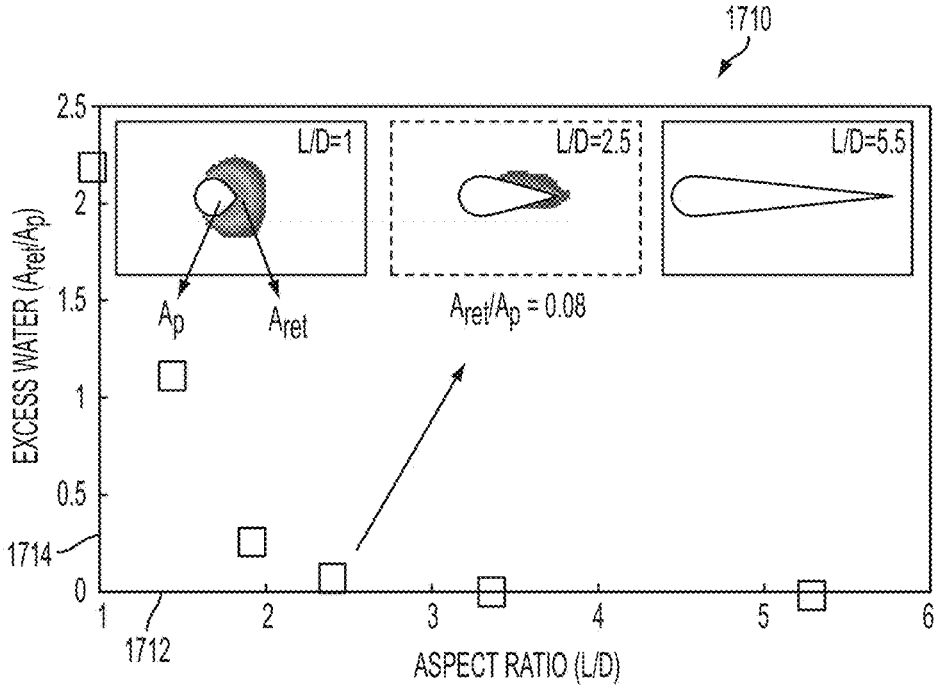
FIG. 17B is a graph that illustrates an example dependence of entrained solution area (Aret) on aspect ratio of a teardrop shaped post, according to an embodiment.

A better hydrogel shape was rationally engineered by computationally modeling a two-phase flow around a post in a channel. From simulations, it was immediately apparent that water pinches off from the edge of the cylindrical post in a "raindrop" shape that may be a better geometric design for the gel. This was then experimentally confirmed (e.g., see post 1310*d* in FIG. 13). Further simulations were performed to optimize dimensions. The key parameter that determined water entrainment fraction around the post (e.g., 1320*d* relative to 1310*d*) was found to be ratio of the length of the post (L) to its diameter (D). As L/D increases, there is better encapsulation. FIG. 17B is a graph 1710 that illustrates an example dependence of entrained solution area (Aret) on aspect ratio of a teardrop shaped post, according to an embodiment. The horizontal axis 1712 indicates aspect ratio (L/D), which is dimensionless. The vertical axis 1714 indicates excess water given by the ratio of Aret to the cross sectional area of the post (Ap), also dimensionless. The excess water is negligible (less than 10%) above about 2.5.

From a practical standpoint though, increasing post length decreased channel space for multiplexing. Considering this trade off, L/D=2.5 was used for all ensuing studies, since there was minimal benefit in increasing L/D further. In other embodiments, L/D in a range from about 2 to about 3 is advantageous to reduce water entrainment and still allow multiple reaction volumes in a detection area.

Figure 17C:
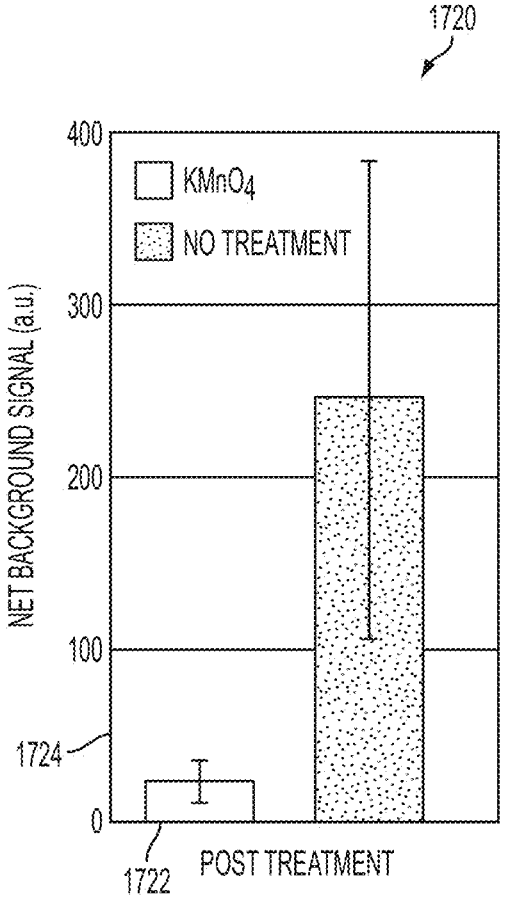
FIG. 17C is a graph that illustrates example dependence of background due to non-specific binding on use of potassium permaganate, according to an embodiment.

From a chemical standpoint, it was an aim to minimize assay time while maximizing signal to noise ratios (SNRs) by adjusting the gel environment. For example, overcoming kinetic barriers in short (15 min) enzyme incubations recommended use of SAB at high (2 ng/μl) concentration, but there was a tendency for collection of high nonspecific signal at these conditions. It was hypothesized that this could be due to relative hydrophobicity of the hydrogel, which likely has double bonds from unconverted acrylate groups during the polymerization process. A chemical (potassium permanganate, $KMnO_4$) that oxidized these double bonds was used to make the gel hydrophilic (e.g., during step 201). Indeed, it was found that the $KMnO_4$ treatment drastically decreased nonspecific signal. FIG. 17C is a graph that illustrates example dependence of background due to nonspecific binding on use of potassium permanganate, according to an embodiment. The horizontal axis 1722 indicates whether the post was treated with potassium permanganate, $KMnO_4$, and the vertical axis indicates net background signal in arbitrary units—a measure of non-specific binding. To perform this additional oxidization step to make the gel more hydrophilic and reduce non-specific binding, 0.1M Tris buffer pH-adjusted to 8.8 was prepared and $KMNO_4$ was added to a final concentration of 500 μM. The solution was prepared fresh before each reaction and it was visually ensured that the color of the solution was purple. The posts were treated with this solution for 5 minutes and immediately rinsed with 1×TE.

Figure 17D:
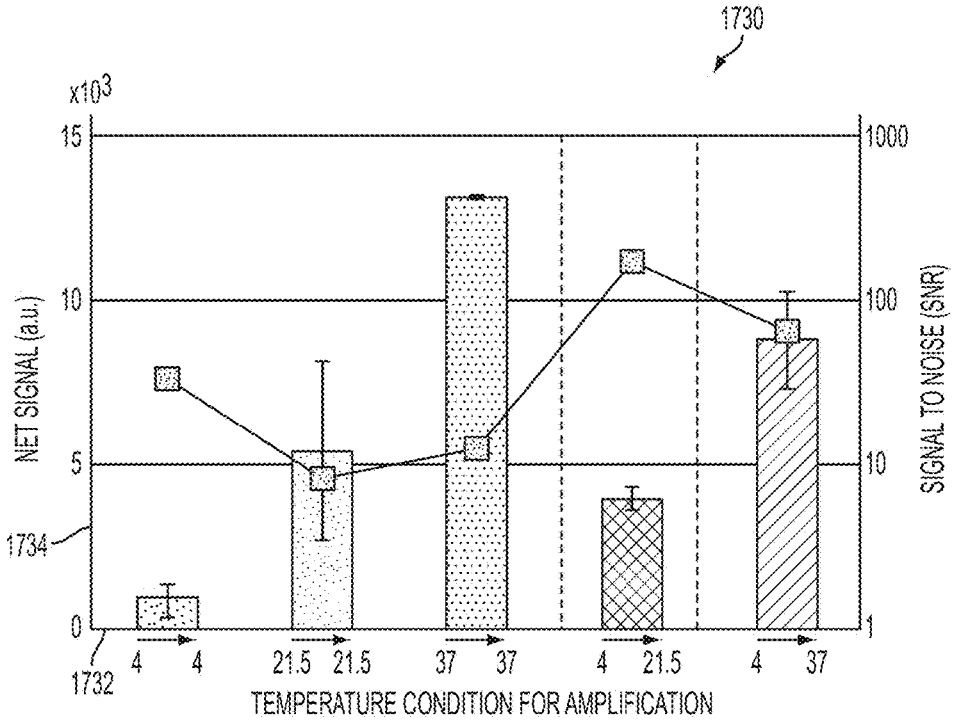
FIG. 17D is a graph that illustrates example dependence of signal on temperature conditions, according to an embodiment.

The impact of amplification temperature was next explored since SAB has demonstrated temperature dependence in previous studies. Interestingly, at low temperatures (4° C.) the enzymatic reaction was almost entirely arrested whereas at increased temperatures (21.5, 37° C.), there was significantly higher signal but lower SNRs. Optimization was performed by incorporating a biotinylated DNA sequence into gel posts at a final concentration of 5 μM and assessing signal and SNRs at different temperature conditions. Background was subtracted using blank posts without probe in the same channels. Ultimately, approximately optimal results and highest SNRs were gained by combining low temperature and high temperature conditions. FIG. 17D is a graph 1730 that illustrates example dependence of signal on temperature conditions, according to an embodiment. The horizontal axis 1732 indicates temperature conditions in degrees Celsius (° C.) during the steps of the method of FIG. 2. The vertical axis 1724 indicates the net signal obtained in arbitrary units.

Figure 17E:
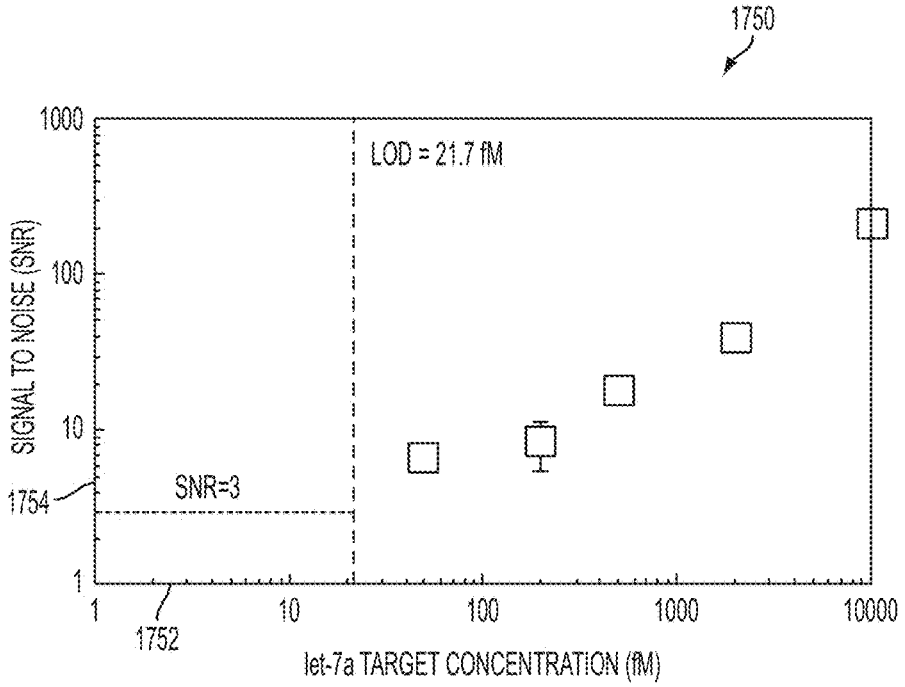
FIG. 17E is a graph that illustrates example calibration curve for let-7a detection, according to an embodiment.

The chip was cooled to 4° C. for the substrate/oil flush, which is hypothesized to enable more uniform substrate loading, and was then brought to 21.5° C. for the remainder of the reaction. Together, optimization of gel chemistry and amplification temperature significantly reduced incubation times relative to our previous work (30 min here vs. 80 min above) while still achieving high sensitivity without post-to-post crosstalk. Furthermore, this optimized scheme eliminated any need for channel surface treatments such as fluorination, which often deposit nonuniformly and make channel cleaning difficult. The assay now demonstrated a let-7a detection limit of 21.7 fetoMolar (fM, 1 fM=$10^{-15}$ Molar), which is over one order of magnitude better than previously mentioned competing on-chip assays. FIG. 17E is a graph 1750 that illustrates example calibration curve for let-7a detection, according to an embodiment. The logarithmic horizontal axis 1752 indicates let-7a target concentration in fM; and the logarithmic vertical axis 1754 indicates the signal to noise ratio (dimensionless).

When using small volumes (200 μL) of target solutions, the channel with gel posts was soaked in 1×TE overnight to saturate the PDMS and reduce evaporation during the target hybridizations. All target hybridizations took place in a TET buffer with a final concentration of 250 mM NaCl. The hybridization mixture was prepared either using synthetic RNA sequences (purchased from IDT and serially diluted in 1×TE) or using total RNA (BioChain, stored at 100 ng/μL at −20° C.).

For all assays done with total RNA, 10 pM of a synthetic RNA control (miSpike, IDT) was also spiked in, to ensure that flow conditions yielded constant conditions. In addition, for total RNA assays, before the assay started, the solution was brought to 95° C. for 5 min in a thermoshaker to disrupt secondary structures. It was cooled over a period of 7 min before being put in the microchannel. Pre-cut pipette tips were loaded with solution, interfaced with the device, and finally the device was placed on a hotplate that was set to 55° C. for 90 minutes, heating the device via conduction. A steady flow was sustained over this entire period.

It is noted here that significant signal differences were not observed along the length of the channel, implying that the temperature profile of the solution inside was kept constant. Furthermore, due to the high conductivity of glass (1.4 W/m° K) and the low thickness of the glass device (0.85 mm), the bottom surface of the channel is maintained at the same temperature as the hot plate according to a simple heat transfer calculation. It was also verified that it was unnecessary to pre-heat the solutions before introducing them into the device, since signals obtained by performing this step did not demonstrate any significant differences. After the target incubation, solutions were brought back to room temperature.

Although here the solutions in the pipette were periodically re-filled, it should be possible to make this unnecessary by further controlling flow conditions.

All rinses were done using a stringent buffer which contained 50 mM NaCl in TET, and solutions was pipetted through the channel for 30 seconds to remove all unreacted target. Optimized rinse buffer composition were used previously, which imposed sufficient stringency while allowing high sensitive detection. For ligation, the universal linker sequence (IDT, 40 nM, see Table S1), T4 DNA ligase (800 U/mL), ATP (250 nM), and 10×NEB2 buffer (all from New England Biolabs) with TET (1×) were used as described in detail in previous publications. This solution was flowed through the channel for 10 minutes. After one more 30-second rinse step, the channel was loaded with either streptavidin-phycoerythin for 30 min (SA-PE, diluted to 2 ng/μl in rinse buffer) or with streptavidin β-galactosidase for 15 min (SAB, diluted to 2 ng/μl in 1×PBS). At this stage, the assay was completed if labeling were with SA-PE.

Otherwise, the enzymatic substrate, fluorescein-di-β-galactosidase (FDG) was prepared at a concentration of 200 μM and the chip cooled to 4° C. Substrate was then flushed through the channel for 30 seconds and immediately followed by a 30 second flush of FC-40. The chip temperature was raised to 21.5° C. for a total amplification time of 15 minutes.

In both cases, fluorescence imaging was performed using a Zeiss Axiovert A1 microscope (10× objective) and a halide light source (Prior Lumen 200, set to 100%). Since SA-PE and FDG emit at different wavelengths, dichroic filter sets appropriate for each fluorophore (purchased from Chroma) were chosen. Typically, imaging for a single channel took less than 5 minutes. A custom semi-automated image analysis script was written in MATLAB that used edge detection to extract signal from individual posts. Both brightfield and fluorescence images were taken of each frame. Brightfield images were used to locate posts; and, signal was extracted from the fluorescence images by averaging over the entire area of the post. About 5-7 posts were analyzed per target.

For miRNA diagnostic assays, sensitivity is most relevant in the context of total input RNA required for quantification. It was thus sought to minimize total RNA consumption over the hybridization time scale (90 min) that was used while ensuring constant delivery to the posts. It is noted that this input requirement can be drastically reduced by further controlling flow conditions or by running the hybridization for shorter times, which is still expected to give significant signal. Consistent flow delivery was confirmed by measuring signal from 10 pM of a synthetic RNA sequence (miSpike, see Table 3) in all channels. Let-7a was first measured in a representative lung tumor total RNA sample using both SA-PE and the amplification scheme to characterize amount of required input material with both schemes. Using the SA-PE scheme, 171.8 ng RNA was needed; but, with the amplification scheme, this amount was reduced to just 10.8 ng, indicating about 17 times increase in limit of detection over the same assay time. By further controlling flow conditions, it is expected that required input RNA could be as low as 15-200 pg.

This initial let-7a characterization enabled multiplexed measurements for three targets and compare miRNA expression in tumor versus healthy tissue using the on-chip assay. All of the dysregulation patterns we report are expected according to literature. However, this process and apparatus were able to use 10× lower input RNA (50 ng) using the enzymatic amplification scheme relative to the direct labeling scheme (500 ng) to achieve the same results. These results were further validated using previously published gel particle assay, which showed agreement for all targets.

Figure 18A:
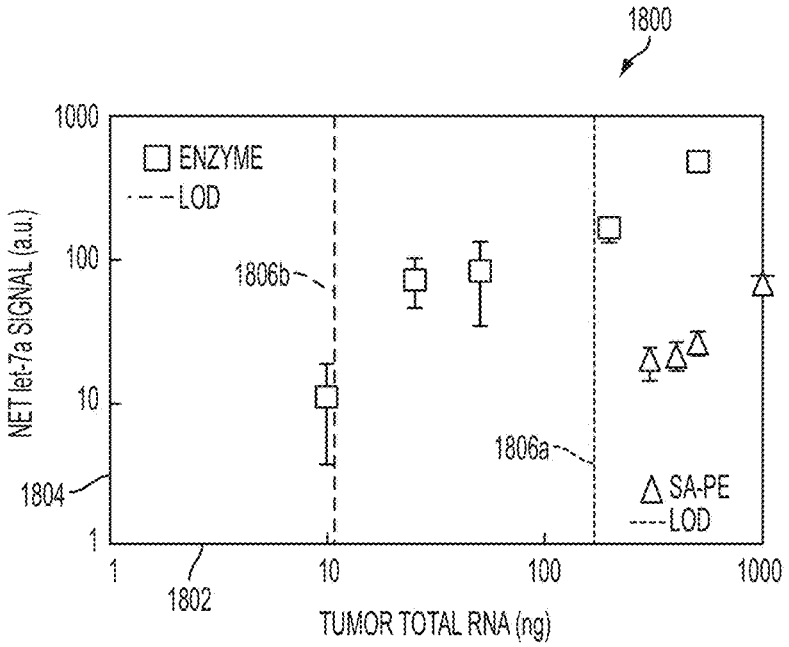
FIG. 18A is a graph that illustrates example let-7 miRNA quantification from total RNA, according to an embodiment.

FIG. 18A is a graph 1800 that illustrates example miRNA quantification from total RNA, according to an embodiment. The logarithmic horizontal axis 1802 indicates total tumor RNA in nanograms (ng). The logarithmic vertical axis 1804 indicates the net let-7a signal in arbitrary units. Using SA-PE the experimental values are indicated by the solid triangles and has a limit of detection (LOD) 1806*a* at 171.8 ng total RNA, so less than that amount is not detectable with this method. In contrast, using the amplification scheme, the experimental values are indicated by the solid squares and have a limit of detection (LOD) 1806*b* at 10.8 ng total RNA, so such low amount is detectable with this method.

Figure 18B:
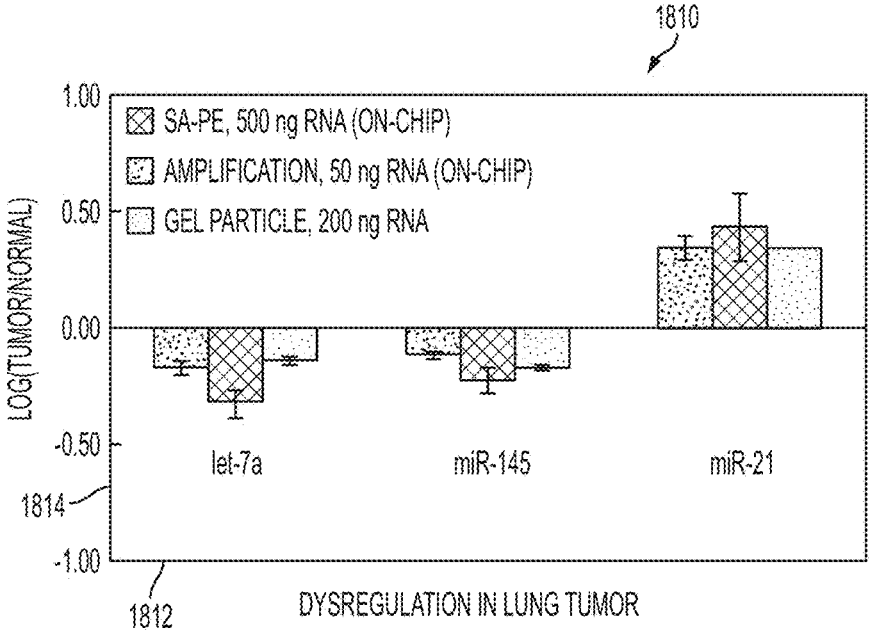
FIG. 18B is a graph that illustrates example comparison of quantifications for several different miRNA, according to an embodiment.

FIG. 18B is a graph 1810 that illustrates example comparison of quantifications for several different miRNA, according to an embodiment. The horizontal axis 1812 indicates different miRNA; and, the vertical axis 1814 indicates the logarithm of the ratio of tumor total RNA to normal total RNA, which is dimensionless. For each miRNA type, the log of the ratio is given first for an on-chip measurement of the SA-PE technique, with total input RNA of 500 ng, then for an on-chip measurement using the amplification technique with a total input RNA of 50 ng, then for a gel particle measurement technique with a total input RNA of 200 ng, respectively. Measurement of dysregulation ratios of 3 miRNAs in healthy versus tumor tissues is a demonstration of ability to measure using less total RNA when employing the enzymatic amplification, thus decreasing the LOD. As expected the amounts of let-7a and miR-145 are reduced in tumor cells, and the amount of miR-21 is increased in tumor cells, relative to normal cells. Results are validated using previously published gel particle results.

Thus is demonstrated on chip, multiplexed analysis of miRNAs from low (50 ng) amounts of total RNA samples. It is expected that the system can be readily integrated into clinical settings for disease diagnosis.

EXTENSIONS, MODIFICATIONS AND ALTERATIONS

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article.

REFERENCES

The entire contents of each of the following references are hereby incorporated by reference as if fully cited herein except for terminology inconsistent with that used herein.

Appleyard, D. C.; Chapin, S. C.; Srinivas, R. L.; Doyle, P. S., Nat. Protoc. 2011, 6, 1761-1774.

Arenkov, P.; Kukhtin, A.; Gemmell, A.; Voloshchuk, S.; Chupeeva, V.; Mirzabekov, A., Anal. Biochem. 2000, 278, 123-131.

Atrazhev, A.; Manage, D. P.; Stickel, A. J.; Crabtree, H. J.; Pilarski, L. M.; Acker, J. P., Anal. Chem. 2010, 82, 8079-8087.

Baret, J. C.; Miller, O. J.; Taly, V.; Ryckelynck, M.; El-Harrak, A.; Frenz, L.; Rick, C.; Samuels, M. L.; Hutchison, J. B.; Agresti, J. J.; Link, D. R.; Weitz, D. A.; Griffiths, A. D., Lab Chip 2009, 9, 1850-1858.

Beebe, D. J.; Moore, J. S.; Bauer, J. M.; Yu, Q.; Liu, R. H.; Devadoss, C.; Jo, B. H., Nature 2000, 404, 588-+.

Beer, N. R.; Hindson, B. J.; Wheeler, E. K.; Hall, S. B.; Rose, K. A.; Kennedy, I. M.; Colston, B. W., Anal. Chem. 2007, 79, 8471-8475.

Bird, R. B.; Stewart, W. E.; Lightfoot, E. N., Transport phenomena. 2nd ed.; J. Wiley: New York, 2002.

Bong, K. W.; Chapin, S. C.; Pregibon, D. C.; Baah, D.; Floyd-Smith, T. M.; Doyle, P. S., Lab Chip 2011, 11, 743-747.

Chang, L.; Rissin, D. M.; Fournier, D. R.; Piech, T.; Patel, P. P.; Wilson, D. H.; Duffy, D. C., J. Immunol. Methods 2012, 378, 102-115.

Chapin, S. C.; Appleyard, D. C.; Pregibon, D. C.; Doyle, P. S., Angew. Chem. 2011, 50, 2289-2293.

Choi, N. W.; Kim, J.; Chapin, S. C.; Duong, T.; Donohue, E.; Pandey, P.; Broom, W.; Hill, W. A.; Doyle, P. S., Anal. Chem. 2012, 84, 9370-9378.

Fotin, A. V.; Drobyshev, A. L.; Proudnikov, D. Y.; Perov, A. N.; Mirzabekov, A. D., Nucleic Acids Res. 1998, 26, 1515-1521.

Gorris, H. H.; Walt, D. R., J. Am. Chem. Soc. 2009, 131, 6277-6282.

Heo, J.; Crooks, R. M., Anal. Chem. 2005, 77, 6843-6851.

Huang, Z. J., Biochemistry 1991, 30, 8535-8540.

Ikami, M.; Kawakami, A.; Kakuta, M.; Okamoto, Y.; Kaji, N.; Tokeshi, M.; Baba, Y., Lab Chip 2010, 10, 3335-3340.

Joensson, H. N.; Samuels, M. L.; Brouzes, E. R.; Medkova, M.; Uhlen, M.; Link, D. R.; Andersson-Svahn, H., Angew. Chem. 2009, 48, 2518-2521.

Johnson, E. M.; Deen, W. M., Aiche J 1996, 42, 1220-1224.

Kan, C. W.; Rivnak, A. J.; Campbell, T. G.; Piech, T.; Rissin, D. M.; Mosl, M.; Peterca, A.; Niederberger, H.-P.; Minnehan, K. A.; Patel, P. P.; Ferrell, E. P.; Meyer, R. E.; Chang, L.; Wilson, D. H.; Fournier, D. R.; Duffy, D. C., Lab Chip 2012, 12, 977-985.

Kim, S. H.; Iwai, S.; Araki, S.; Sakakihara, S.; lino, R.; Noji, H., Lab Chip 2012 12, 4986-4991.

Koh, W. G.; Pishko, M., Sensors and Actuators B-Chemical 2005, 106, 335-342.

Kosto, K. B.; Deen, W. M., Biophys J 2005, 88, 277-286.

Lee, A. G.; Arena, C. P.; Beebe, D. J.; Palecek, S. P., Biomacromolecules 2010, 11, 3316-3324.

Lee, A. G.; Beebe, D. J.; Palecek, S. P., Biomedical Microdevices 2012, 14, 247-257.

Lee, W.; Choi, D.; Kim, J.-H.; Koh, W.-G., Biomedical Microdevices 2008, 10, 813-822.

Lewis, C. L.; Choi, C. H.; Lin, Y.; Lee, C. S.; Yi, H., Anal. Chem. 2010, 82, 5851-5858.

Li, H. Y.; Leulmi, R. F.; Juncker, D., Lab Chip 2011, 11, 528-534.

Liu, J.; Gao, D.; Li, H.-F.; Lin, J.-M., Lab Chip 2009, 9, 1301-1305.

Love, J. C.; Wolfe, D. B.; Jacobs, H. O.; Whitesides, G. M., Langmuir 2001, 17, 6005-6012.

Manage, D. P.; Chui, L. D.; Pilarski, L. M., Microfluid Nanofluid 2013, 14, 731-741.

Manage, D. P.; Lauzon, J.; Atrazhev, A.; Morrissey, Y. C.; Edwards, A. L.; Stickel, A. J.; Crabtree, H. J.; Pabbaraju, K.; Zahariadis, G.; Yanow, S. K.; Pilarski, L. M., Lab Chip 2012, 12, 1664-1671.

Mattern, K. J.; Nakornchai, C.; Deen, W. M., Biophys J 2008, 95, 648-656.

Ogunniyi, A. O.; Story, C. M.; Papa, E.; Guillen, E.; Love, J. C., Nat. Protoc. 2009, 4, 767-782.

Piwonski, H. M.; Goomanovsky, M.; Bensimon, D.; Horovitz, A.; Haran, G., Proc. Natl. Acad. Sci. U.S.A. 2012, 109, E1437-E1443.

Pregibon, D. C.; Doyle, P. S., Anal. Chem. 2009, 81, 4873-4881.

Pregibon, D. C.; Toner, M.; Doyle, P. S., Langmuir 2006, 22, 5122-5128.

Pregibon, D. C.; Toner, M.; Doyle, P. S., Science 2007, 315, 1393-1396.

Proudnikov, D.; Timofeev, E.; Mirzabekov, A., Anal. Biochem. 1998, 259, 34-41.

Rissin, D. M.; Fournier, D. R.; Piech, T.; Kan, C. W.; Campbell, T. G.; Song, L.; Chang, L.; Rivnak, A. J.; Patel, P. P.; Provuncher, G. K.; Ferrell, E. P.; Howes, S. C.; Pink, B. A.; Minnehan, K. A.; Wilson, D. H.; Duffy, D. C., Anal. Chem. 2011, 83, 2279-2285.

Rissin, D. M.; Kan, C. W.; Campbell, T. G.; Howes, S. C.; Fournier, D. R.; Song, L.; Piech, T.; Patel, P. P.; Chang, L.; Rivnak, A. J.; Ferrel, E. P.; Randall, J. D.; Provuncher, G. K.; Walt, D. R.; Duffy, D. C., Nat. Biotechnol. 2010, 28, 595-599.

Rubina, A. Y.; Kolchinsky, A.; Makarov, A. A.; Zasedatelev, A. S., Proteomics 2008, 8, 817-831.

Sakakihara, S.; Araki, S.; Iino, R.; Noji, H., Lab Chip 2010, 10, 3355-3362.

Schmitz, C. H. J.; Rowat, A. C.; Koster, S.; Weitz, D. A., Lab Chip 2009, 9, 44-49.

Song, H.; Chen, D. L.; Ismagilov, R. F., Angew. Chem. 2006, 45, 7336-56.

Song, H.; Tice, J. D.; Ismagilov, R. F., Angew. Chem. 2003, 42, 768-772.

Tewhey, R.; Warner, J. B.; Nakano, M.; Libby, B.; Medkova, M.; David, P. H.; Kotsopoulos, S. K.; Samuels, M. L.; Hutchison, J. B.; Larson, J. W.; Topol, E. J.; Weiner, M. P.; Harismendy, O.; Olson, J.; Link, D. R.; Frazer, K. A., Nat. Biotechnol. 2009, 27, 1025-U94.

Theberge, A. B.; Courtois, F.; Schaerli, Y.; Fischlechner, M.; Abell, C.; Hollfelder, F.; Huck, W., T. S., Angew. Chem. 2010, 49, 5846-5868.

Zhang, H.; Nie, S.; Etson, C. M.; Wang, R. M.; Walt, D. R., Lab Chip 2012 12, 2229-2239.

SEQUENCE LISTING

```
<160> NUMBER OF SEQ ID NOS: 20

<210> SEQ ID NO 1
<211> LENGTH: 20
<212> TYPE: DNA
<213> ORGANISM: Artificial Sequence
<220> FEATURE:
<223> OTHER INFORMATION: Synthetic: Biotinylated DNA
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (20)..(20)
<223> OTHER INFORMATION: 3' biotinylated

<400> SEQUENCE: 1

atagcagatc agcagccaga                                                20


<210> SEQ ID NO 2
<211> LENGTH: 20
<212> TYPE: DNA
<213> ORGANISM: Artificial Sequence
<220> FEATURE:
<223> OTHER INFORMATION: Synthetic: DNA Probe 1
<220> FEATURE:
<221> NAME/KEY: misc_feature
<222> LOCATION: (1)..(1)
<223> OTHER INFORMATION: 5' acrydite modification

<400> SEQUENCE: 2

atagcagatc agcaggcaga                                                20


<210> SEQ ID NO 3
<211> LENGTH: 20
<212> TYPE: DNA
```

<213> ORGANISM: Artificial Sequence
<220> FEATURE:
<223> OTHER INFORMATION: Synthetic: DNA Probe 2
<220> FEATURE:
<221> NAME/KEY: misc_feature
<222> LOCATION: (1)..(1)
<223> OTHER INFORMATION: 5' acrydite modification

<400> SEQUENCE: 3 cactatgcgc aggttctcat 20

<210> SEQ ID NO 4
<211> LENGTH: 20
<212> TYPE: DNA
<213> ORGANISM: Artificial Sequence
<220> FEATURE:
<223> OTHER INFORMATION: Synthetic: DNA Probe 3
<220> FEATURE:
<221> NAME/KEY: misc_feature
<222> LOCATION: (1)..(1)
<223> OTHER INFORMATION: 5' acrydite modification

<400> SEQUENCE: 4 gtacccacgt ctagcatagc 20

<210> SEQ ID NO 5
<211> LENGTH: 20
<212> TYPE: DNA
<213> ORGANISM: Artificial Sequence
<220> FEATURE:
<223> OTHER INFORMATION: Synthetic: DNA Target 1
<220> FEATURE:
<221> NAME/KEY: misc_feature
<222> LOCATION: (1)..(1)
<223> OTHER INFORMATION: 5' biotinylated

<400> SEQUENCE: 5 tctgcctgct gatctgctat 20

<210> SEQ ID NO 6
<211> LENGTH: 20
<212> TYPE: DNA
<213> ORGANISM: Artificial Sequence
<220> FEATURE:
<223> OTHER INFORMATION: Synthetic: DNA Target 2
<220> FEATURE:
<221> NAME/KEY: misc_feature
<222> LOCATION: (1)..(1)
<223> OTHER INFORMATION: 5' biotinylated

<400> SEQUENCE: 6 atgagaacct gcgcatagtg 20

<210> SEQ ID NO 7
<211> LENGTH: 20
<212> TYPE: DNA
<213> ORGANISM: Artificial Sequence
<220> FEATURE:
<223> OTHER INFORMATION: Synthetic: DNA Target 3
<220> FEATURE:
<221> NAME/KEY: misc_feature
<222> LOCATION: (1)..(1)
<223> OTHER INFORMATION: 5' biotinylated

<400> SEQUENCE: 7 gctatgctag acgtgggtac 20

<210> SEQ ID NO 8
<211> LENGTH: 33

<212> TYPE: DNA
<213> ORGANISM: Artificial Sequence
<220> FEATURE:
<223> OTHER INFORMATION: Synthetic: let-7a probe
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (33)..(33)
<223> OTHER INFORMATION: 3' InvdT

<400> SEQUENCE: 8 gatatatttt aaactataca acctactacc tca 33

<210> SEQ ID NO 9
<211> LENGTH: 22
<212> TYPE: RNA
<213> ORGANISM: Artificial Sequence
<220> FEATURE:
<223> OTHER INFORMATION: Synthetic: let-7a target

<400> SEQUENCE: 9 ugagguagua gguuguauag uu 22

<210> SEQ ID NO 10
<211> LENGTH: 22
<212> TYPE: RNA
<213> ORGANISM: Artificial Sequence
<220> FEATURE:
<223> OTHER INFORMATION: Synthetic: let-7b target

<400> SEQUENCE: 10 ugagguagua gguugugugg uu 22

<210> SEQ ID NO 11
<211> LENGTH: 22
<212> TYPE: RNA
<213> ORGANISM: Artificial Sequence
<220> FEATURE:
<223> OTHER INFORMATION: Synthetic: let-7c target

<400> SEQUENCE: 11 ugagguagua gguuguaugg uu 22

<210> SEQ ID NO 12
<211> LENGTH: 22
<212> TYPE: RNA
<213> ORGANISM: Artificial Sequence
<220> FEATURE:
<223> OTHER INFORMATION: Synthetic: let-7d target

<400> SEQUENCE: 12 cgagguagua gguugcauag uu 22

<210> SEQ ID NO 13
<211> LENGTH: 33
<212> TYPE: DNA
<213> ORGANISM: Artificial Sequence
<220> FEATURE:
<223> OTHER INFORMATION: Synthetic: miR-21 probe
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (33)..(33)

<223> OTHER INFORMATION: 3' InvdT

<400> SEQUENCE: 13 gatatatttt atcaacatca gtctgataag cta 33

<210> SEQ ID NO 14
<211> LENGTH: 22
<212> TYPE: RNA
<213> ORGANISM: Artificial Sequence
<220> FEATURE:
<223> OTHER INFORMATION: Synthetic: miR-21 target

<400> SEQUENCE: 14 uagcuuauca gacugauguu ga 22

<210> SEQ ID NO 15
<211> LENGTH: 34
<212> TYPE: DNA
<213> ORGANISM: Artificial Sequence
<220> FEATURE:
<223> OTHER INFORMATION: Synthetic: miR-145 probe
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (34)..(34)
<223> OTHER INFORMATION: 3' InvdT

<400> SEQUENCE: 15 gatatatttt aagggattcc tgggaaaact ggac 34

<210> SEQ ID NO 16
<211> LENGTH: 23
<212> TYPE: RNA
<213> ORGANISM: Artificial Sequence
<220> FEATURE:
<223> OTHER INFORMATION: Synthetic: miR-145 target

<400> SEQUENCE: 16 guccaguuuu cccaggaauc ccu 23

<210> SEQ ID NO 17
<211> LENGTH: 32
<212> TYPE: DNA
<213> ORGANISM: Artificial Sequence
<220> FEATURE:
<223> OTHER INFORMATION: Synthetic: miSpike probe
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (32)..(32)
<223> OTHER INFORMATION: 3' InvdT

<400> SEQUENCE: 17 gatatatttt aagaccgctc cgccatcctg ag 32

<210> SEQ ID NO 18
<211> LENGTH: 21
<212> TYPE: RNA
<213> ORGANISM: Artificial Sequence
<220> FEATURE:
<223> OTHER INFORMATION: Synthetic: miSpike target

<400> SEQUENCE: 18

-continued

```
cucaggaugg cggagcgguc u                                                21


<210> SEQ ID NO 19
<211> LENGTH: 22
<212> TYPE: DNA
<213> ORGANISM: Artificial Sequence
<220> FEATURE:
<223> OTHER INFORMATION: Synthetic: universal linker
<220> FEATURE:
<221> NAME/KEY: misc_feature
<222> LOCATION: (1)..(1)
<223> OTHER INFORMATION: 5' Phos
<220> FEATURE:
<221> NAME/KEY: misc_feature
<222> LOCATION: (22)..(22)
<223> OTHER INFORMATION: 3' biotinylated

<400> SEQUENCE: 19

taaaatatat aaaaaaaaaa aa                                               22


<210> SEQ ID NO 20
<211> LENGTH: 20
<212> TYPE: DNA
<213> ORGANISM: Artificial Sequence
<220> FEATURE:
<223> OTHER INFORMATION: Synthetic: Biotinylated probe
<220> FEATURE:
<221> NAME/KEY: misc_feature
<222> LOCATION: (1)..(1)
<223> OTHER INFORMATION: 5' acrydite modification
<220> FEATURE:
<221> NAME/KEY: misc_feature
<222> LOCATION: (20)..(20)
<223> OTHER INFORMATION: 3' biotinylated

<400> SEQUENCE: 20

atagcagatc agcagccaga                                                  20
```

What is claimed is:

1. An apparatus comprising a structural substrate and one or more hydrogel microstructures, each comprising a plurality of pores and a hydrogel frame surrounding the pores, wherein:

the structural substrate is a microchannel;

the hydrogel frame comprises a plurality of covalently embedded molecules of a probe species selected to bind to a target molecule;

each hydrogel microstructure has a volume confined to a range from about 1 picoliter to about 10,000 picoliters;

the one or more microstructures are fixed to the structural substrate; and the plurality of pores have a pore size configured to pass the target molecule in solution through the microstructure by diffusion for binding to the probe species and prevent advection of a hydrophobic fluid through the pores when the device is flushed with the hydrophobic fluid at pressures in a range from about 0.2 pounds per square inch to about 25 pound per square inch, the device further comprising:

a first fluid container configured to flush the microchannel with the first solution including the target molecule;

a second fluid container configured to flush the microchannel with a second solution that comprises a reactant molecule that reacts with the target molecule to produce an observable product molecule;

a third fluid container configured to flush the hydrogel microstructure with a hydrophobic fluid for an extended observation duration selected in a range from about 1 second to about 10,000 seconds; and a port configured for observing the observable product molecule at some time during the observation duration.

2. A hydrogel microstructure as recited in claim 1, wherein the pore size is greater than about 5 nanometers whereby large biomolecules may pass into the microstructure.

3. A hydrogel microstructure as recited in claim 1, wherein the covalently embedded molecules of the probe species include an acrylate group.

4. An apparatus as recited in claim 1, wherein the hydrogel frame comprises a plurality of covalently embedded molecules of a probe species selected to bind to the target molecule, whereby the target molecule in the first solution binds with a molecule of the plurality of covalently embedded molecules of the probe species.

5. An apparatus as recited in claim 1, further comprising a fourth source configured to flush the microchannel with a fourth solution that comprises an enzyme that binds to the target molecule, wherein the reactant molecule is a substrate molecule that the enzyme converts to the observable product molecule.

6. An apparatus as recited in claim 1, further comprising a rinse source configured to flush the microchannel with a rinse solution selected to remove at least one of the hydrophobic fluid or the target molecule or the reactant molecule or the observable product molecule.

7. An apparatus as recited in claim 1, wherein the hydrogel microstructure is shaped to form an external reservoir of the second solution when the hydrogel microstructure is flushed with the hydrophobic fluid flowing past the microstructure.

8. A device comprising a microchannel and one or more hydrogel microstructures, each comprising a plurality of pores and a hydrogel frame surrounding the pores, wherein:

the hydrogel frame comprises a plurality of covalently embedded molecules of a probe species selected to bind to a target molecule;

each hydrogel microstructure has a volume confined to a range from about 1 picoliter to about 10,000 picoliters;

the plurality of pores have a pore size configured to pass the target molecule in solution through the microstructure by diffusion for binding to the probe species and prevent advection of a hydrophobic fluid through the pores when the device is flushed with the hydrophobic fluid at pressures in a range from about 0.2 pounds per square inch to about 25 pound per square inch; and each hydrogel microstructure is a microparticle not affixed to the device, the device further comprising:

a first fluid container configured to flush the microchannel with the first solution including the target molecule;

a second fluid container configured to flush the microchannel with a second solution that comprises a reactant molecule that reacts with the target molecule to produce an observable product molecule;

a fluid source configured to flush the hydrogel microstructure with the hydrophobic fluid for an extended observation duration selected in a range from about 1 second to about 10,000 seconds, wherein the fluid source comprises a vortex that emulsifies the second solution around the microparticle in the hydrophobic fluid; and a port configured for observing the observable product molecule at some time during the observation duration.

9. An apparatus as recited in claim 1, wherein the one or more hydrogel microstructures are a plurality of hydrogel microstructures.

10. An apparatus as recited in claim 4, further comprising a different hydrogel microstructure having at least one of a different probe species selected to bind to a different target molecule or a different volume or a different pore size.

11. The device as recited in claim 1, wherein the microchannel has a total height h and the pore size is characterized by a size r and a ratio of $h^2$ divided by $r^2$ is much greater than 1.

* * * * *